US005086475A

United States Patent [19]

Kutaragi et al.

[11] Patent Number: 5,086,475

[45] Date of Patent: Feb. 4, 1992

[54] APPARATUS FOR GENERATING, RECORDING OR REPRODUCING SOUND SOURCE DATA

[75] Inventors: Ken Kutaragi; Makoto Furuhashi, both of Kanagawa; Masakazu Suzuoki, Tokyo; Koji Kageyama, Kanagawa, all of Japan

[73] Assignee: Sony Corporation, Tokyo, Japan

[21] Appl. No.: 436,423

[22] Filed: Nov. 14, 1989

[30] Foreign Application Priority Data

| | | | |
|---|---|---|---|
| Nov. 19, 1988 | [JP] | Japan | 63-292931 |
| Nov. 19, 1988 | [JP] | Japan | 63-292933 |
| Nov. 19, 1988 | [JP] | Japan | 63-292934 |
| Nov. 19, 1988 | [JP] | Japan | 63-292935 |
| Nov. 29, 1988 | [JP] | Japan | 63-301544 |
| Feb. 3, 1989 | [JP] | Japan | 1-025564 |

[51] Int. Cl.[5] ..... G10L 9/14; G10H 17/00

[52] U.S. Cl. ..... 381/36; 381/51; 84/603

[58] Field of Search ..... 381/29–40, 381/51; 84/603, 601, 602, 607; 364/513.5, 718, 724.1, 715.02

[56] References Cited

U.S. PATENT DOCUMENTS

| | | | |
|---|---|---|---|
| 3,816,664 | 6/1974 | Koch | 381/30 |
| 4,140,876 | 2/1979 | Gagnon | 381/30 |
| 4,271,500 | 6/1981 | Fjällbrant | 381/33 |
| 4,509,185 | 4/1985 | Grunberg | 381/34 |
| 4,550,425 | 10/1985 | Andersen et al. | 381/34 |
| 4,602,545 | 7/1986 | Starkey | 84/1.01 |
| 4,626,827 | 12/1986 | Kitamura et al. | 381/31 |
| 4,638,706 | 1/1987 | Nagashima et al. | 84/1.01 |
| 4,638,709 | 1/1987 | Nagashima et al. | 84/1.19 |
| 4,667,556 | 5/1987 | Hanzawa et al. | 84/603 |
| 4,696,214 | 9/1987 | Ichiki | 84/603 |
| 4,715,257 | 12/1987 | Hoshiai et al. | 84/1.01 |
| 4,719,833 | 1/1988 | Katoh et al. | 84/1.01 |
| 4,907,484 | 3/1990 | Suzuki et al. | 381/51 |

FOREIGN PATENT DOCUMENTS

| | | |
|---|---|---|
| 0187211A1 | 7/1986 | European Pat. Off. . |
| 1404768 | 9/1975 | United Kingdom . |
| 1404769 | 9/1975 | United Kingdom . |
| 2021342A | 11/1979 | United Kingdom . |

*Primary Examiner*—Dale M. Shaw
*Assistant Examiner*—Michelle Doerrler
*Attorney, Agent, or Firm*—Philip M. Shaw, Jr.

[57] ABSTRACT

An apparatus for looping or data-compressing sampled waveform data digitized from musical sound signals (or the like) to produce sound source data, recording the sound source data on a storage medium, and reading out the sound source data from the storage medium for reproduction. To eliminate amplitude discontinuities at repetition points during looping, two connection samples of repetitive waveform portions having values closest to each other are selected from actual samples and interpolated samples. An interpolation filter performs multiple oversampling to produce the interpolated samples. The interpolation filter includes a filter for each degree of oversampling, and all the filters have the same amplitude characteristics. By asserting pulse code modulated data at the beginning portion of a looping domain, adverse compression effects can be avoided without the necessity of providing compression parameters. When reading out sound source data from the storage medium, a data start address and a looping start address are loaded, in that order, into an address generator. A discriminating flag indicating the presence or absence of the looping domain and a discriminating flag indicating the end of the sound source data can be included in the sound source data to facilitate control of looping or end of reproduction.

6 Claims, 24 Drawing Sheets

| | 8 BITS (1 BYTE) | | | |
|---|---|---|---|---|
| | 4 BITS | | | |
| | D7 D4 | D3 D2 | D1 | D0 |
| RF | RANGE DATA | FILTER DATA | PRESENCE OR ABSENCE OF LOOP | END |
| DA0 | DA0H | DA0L | | |
| DB0 | DB0H | DB0L | | |
| DA1 | DA1H | DA1L | | |
| DB1 | DB1H | DB1L | | |
| DA2 | DA2H | DA2L | | |
| DB2 | DB2H | DB2L | | |
| DA3 | DA3H | DA3L | | |
| DB3 | DB3H | DB3L | | |

FIG. 23A
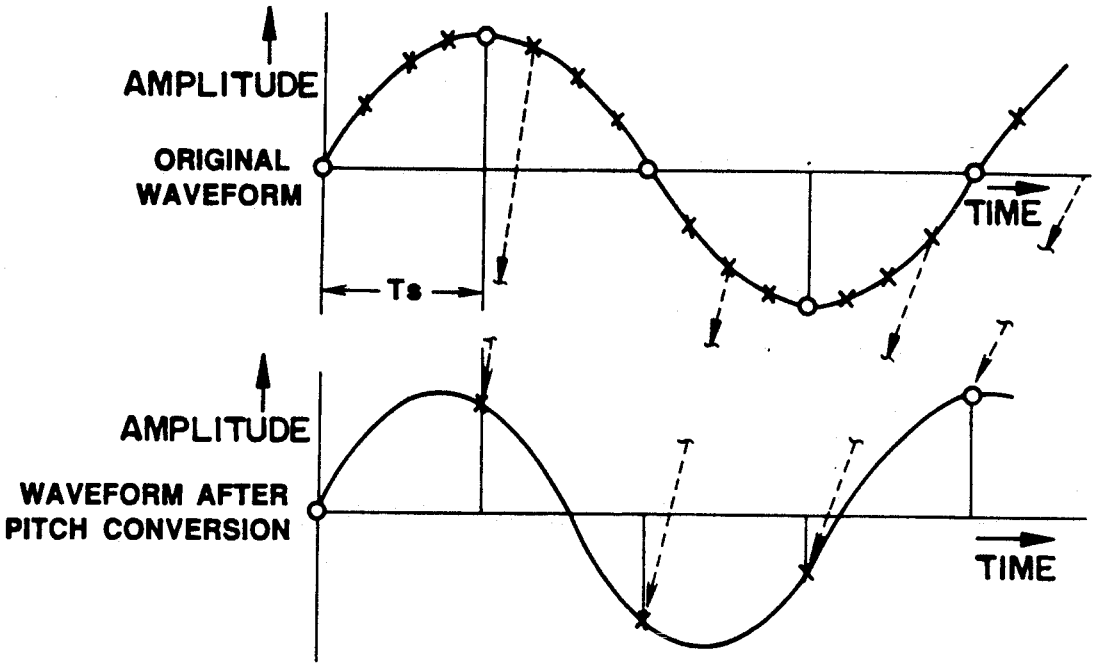
FIG. 23B
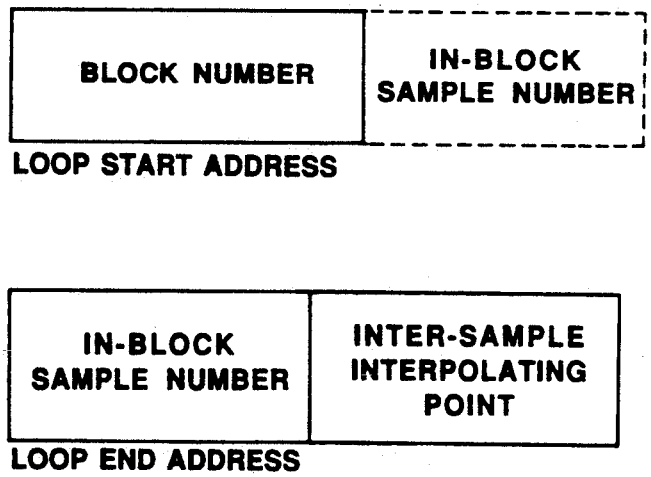
FIG. 25

APPARATUS FOR GENERATING, RECORDING OR REPRODUCING SOUND SOURCE DATA

BACKGROUND OF THE INVENTION

1. Field of the Invention

This invention relates to an apparatus for generating, recording or reproducing sound source data. More particularly, it relates to such apparatus according to which adaptive data compression or looping taking advantage of the periodicity of the musical input sound signal may be realized efficiently.

2. Description of the Prior Art

In general, a sound source used in an electronic musical instrument or a TV game unit may be roughly classified into an analog sound source composed of, for example, VCO, VCA, and VCF, and a digital sound source such as a programmable sound generator (PSG) or a waveform ROM read-out type sound source. As a kind of the digital sound source, there has come to be known a sampler sound source which generates sound source data by sampling and digitizing live sounds of musical instruments and stores the resulting data in a memory.

Since a large capacity memory is generally required with the sampler sound source for storing sound source data, various techniques have been proposed for memory saving. Typical of these are a looping taking advantage of the periodicity of the waveform of the musical sound and bit compression by non-linear quantization.

The above mentioned looping is also a technique for producing a sound for a longer time than the original duration of the sampled musical sound. Considering the waveform of, for example, a musical sound, in the waveform portions other than the formant portion directly after start of sound generation, exhibiting inexplicity waveform periodicity, the same waveform appears repeatedly at a fundamental period corresponding to the pitch or height of the musical sound. Hence, by grouping an n number of periods of the repetitive waveform, n being an integer, as a looping domain, and repeatedly reproducing the looping domain, if so required, sustained sounds may be produced for a prolonged time with only a small memory capacity.

On the other hand, for bit compression of ordinary audio PCM signals, a system employing a feed forward type filter on the encoder side is generally employed. This system transmits sub-data, that is the data concerning compression, in addition to the compressed data, with the filter on the decoder being an IIR (Infinite Impulse Response) or recursive digital filter. Such system is already adopted in, for example, digital optical disk standards.

Meanwhile, sampling the musical sound and looping its tone component is tantamount to connecting and repeatedly looping the looping start and end points of the looping domain. In this case, it is necessary for these looping start and end points to be approximately equal to each other. The reason is that, if otherwise, that is, if discontinuities are present at the connecting points, looping noise is likely to be produced.

However, it is difficult to select the looping start and end points to be substantially equal to each other, by reason of the sampling periods, so that an efficient solution has not be provided by the hitherto known looping method.

Some sounds are devoid of the looping domain, such as those from percussion.

It is noted that, when reading out the sound source data from the memory in which the sound source data are stored, data start address data and looping start address data of the sound source are indicated in a directory which is on the same space as the memory space having the sound source data. These two address data usually have different values. When these address data are permanently loaded in, for example, an address register of an audio signal processing apparatus, an increased number of times of memory fetching represents an increased load especially in case of time division signal processing for generating plural sounds.

On the other hand, the looping domain may or may not be present in the sound source data of the sampler sound source which is to be read out from the memory for reproduction. The processing method for terminating the reproduction of the sound source data depends on whether there is or there is not the looping domain in the sound source data. When terminating the reproduction of the sound source data having the looping domain, it is customary to utilize a looping end point flag included in the sound source data of the looping domain. When terminating the reproduction of the sound source data devoid of the looping domain, suitable measures must be taken to terminate the sound at a predetermined position of the sound source data. Usually a separate address is provided for the reproduction terminating signal.

Thus, when the processing method for terminating the reproduction of the sound source data differs depending on the presence or absence of the looping domain, it is necessary to provide the sound source device performing the above processing operations with separate addresses for the reproduction terminating signals for sound source data devoid of the looping domain and data indicating the presence or absence of the looping domain, thus resulting in an increased memory capacity and a complicated structure of the device.

SUMMARY OF THE INVENTION

In view of the foregoing, it is a principal object of the present invention to provide an apparatus for producing, recording or reproducing sound source data whereby the above mentioned deficiencies may be eliminated.

It is a further object of the present invention to provide a method for compression encoding of sound source data in which discontinuities at the initial portions of a predetermined number of periods, that is, a looping domain, of sound source data, especially at the looping points, may be eliminated, and the memory capacity may be prevented from increasing.

It is a further object of the present invention to provide a sound source device in which the number of times of memory fetching may be diminished.

It is another object of the present invention to provide a method for generating sound data which is freed of discontinuities at the repetitive points at the time of looping to eliminate the looping noise.

It is a further object of the present invention to provide a sound source device in which looping or termination of sound source data reproduction may be controlled easily without increasing the number of sub-data for looping.

It is yet another object of the present invention to provide a continuous sound source data reproducing apparatus whereby continuous reproduction of the musical sound data free of noise may be performed without addition of hardware items or without the necessity of performing complicated timing control operations.

The present invention provides an apparatus for generating sound source data in which waveform data of a predetermined number of actual samples are interpolated to form interpolated samples and in which those of the actual samples and the interpolated samples having the closest values to each other are used as interconnecting samples of a repetitive waveform, whereby discontinuities at the repetitive points are eliminated to enable a satisfactory repetitive reproduction.

The present invention also provides an interpolation filter comprised of an m number of suites of n'th order filters for producing interpolated data at a resolution of the m-ple sampling frequency m fs from input digital data having the sampling frequency fs, wherein the amplitude characteristics of each filter suit are made equal to eliminate the noise produced at the time filter switching.

The present invention also provides a method for compression encoding waveform data into compressed data words and parameters concerning the compression with blocks taken at intervals of plural samples as units, comprising compression encoding a predetermined number of periods of waveform data into one or more compression encoding blocks including a predetermined number of compressed data words and parameters, storing the data in a storage medium, such as a memory, and modulating a predetermined number of leading words of at least a first one of one or more compression encoding blocks by straight PCM to avoid the errors otherwise caused by data discontinuities of said first block at the time of reproducing sound source data without increasing the capacity of the storage medium.

The present invention also provides a sound source device in which a smaller number of times of memory fetches sufficies and which comprises a sound source data memory for storing sound source data including first consecutive plural samples and second consecutive plural samples, a starting address data memory for storing data start address data associated with said sound source data and looping start address data, and an address generator for generating a read-out address of said sound source data memory on the basis of said data start address data and said looping start address data, wherein after said data start address data are loaded into said address generator, said first consecutive plural samples are read out from a storage region of said sound source data memory beginning with said data start address, on the basis of said sound source data memory, and said looping start address data are loaded into said address generator to repeatedly read out said second consecutive plural samples from a storage region beginning with said looping start address of said sound source data memory to reproduce analog or digital audio signals.

The present invention also provides a sound source device in which looping control is facilitated without increasing addition data for looping and which comprises a sound source data memory for selectively storing sound source data including a first kind of consecutive plural samples having a looping domain which is repetitively reproduced and a second kind of consecutive plural samples devoid of said looping domain, and a flag check circuit detecting a discriminating flag indicating the presence or absence of the looping domain of said sound source data and the end of said sound source data, wherein said first kind of plural consecutive samples are repeatedly read out or said second kind of plural consecutive samples are read out from said sound source data memory to reproduce analog or digital audio signals and wherein muting is applied when said discriminating flag indicates the absence of the looping domain and the end of the sound source data.

The present invention also provides an apparatus for reproducing continuous sound source data in which continuous sound source data is enabled and which comprises a sound source memory having first and second sound source memory areas, an address register designating a read-out address on the basis of a start address of said address register, control means for reading sound source data from one of the memory areas on the basis of said read-out address, sound source data supply means for writing sound source data in one of the sound source memory areas during the time when sound source data are read out from the other of said sound source memory. devices, start address supplying means for writing in said address register the start address of said first or second sound source area in which said sound source data are written, and signal processing means for processing the sound source data read out from said first and second sound source memory areas.

The above and further objects and novel features of the present invention will more fully appear from the following detailed description taken in connection with the accompany drawings. It is to be expressly understood, however, that the drawings are for purposes of illustration only and are not intended as a definition of the limits of the invention.

BRIEF DESCRIPTION OF THE DRAWINGS

FIGS. 23A–23B are waveform diagrams for illustrating the pitch conversion.

FIG. 25 is a view for illustrating the loop start and loop end addresses.

DETAILED DESCRIPTION OF THE PREFERRED EMBODIMENTS

Figure 1:
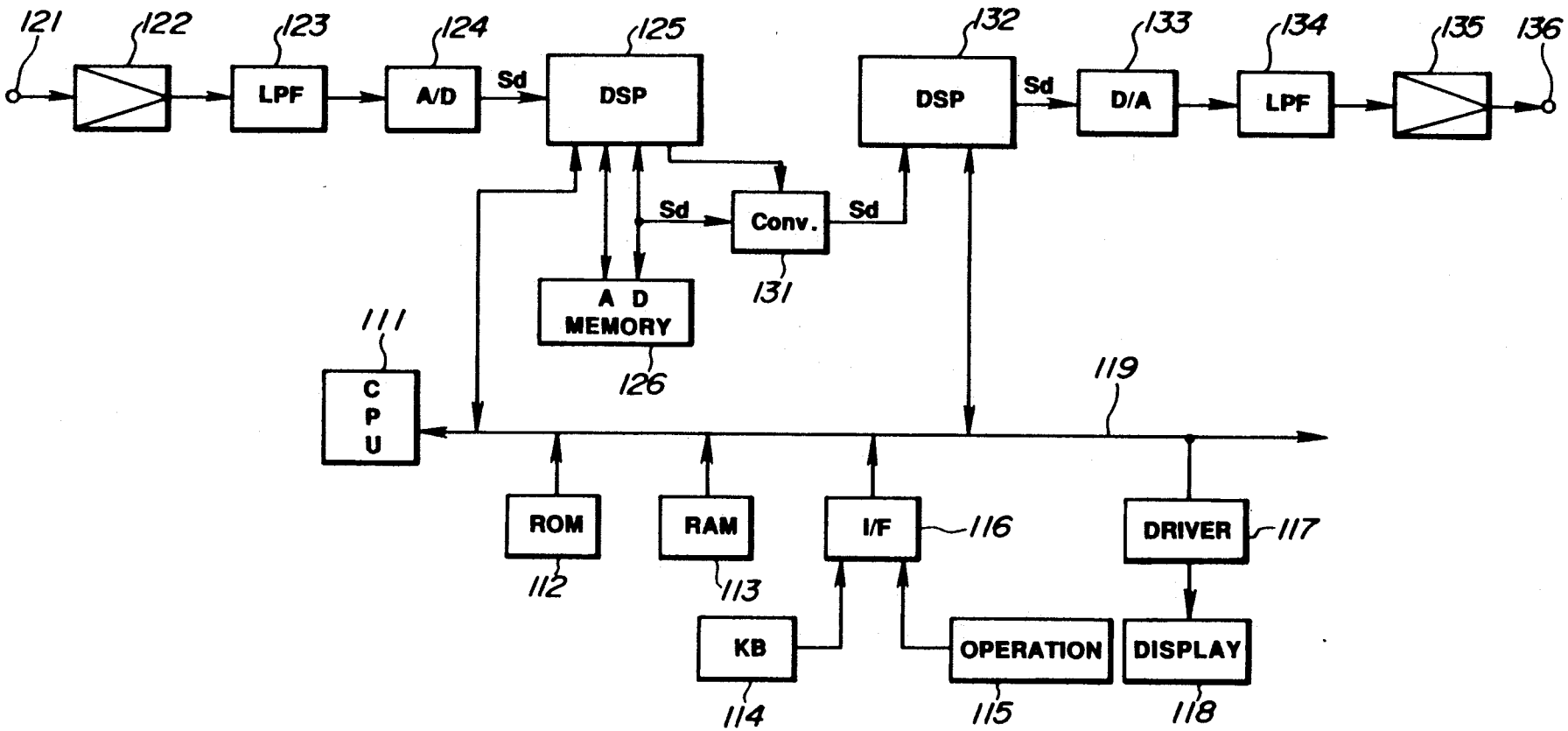
FIG. 1 is a block diagram showing an arrangement of a sound source data forming, recording or reproducing apparatus according to the present invention.

By referring to the drawings, several illustrative embodiments of the present invention will be explained in detail. It is however to be understood that, although the present invention is applied to the apparatus for generating, recording and/or reproducing sound source data, the present invention may also be applied to digital signal processing in general.

FIG. 1 shows the general arrangement of an apparatus for generating, recording and reproducing sound source data to which the present invention is applied and which is employed in a sampling sound source unit as an adapter for personal computer or a sound source section of an electronic musical instrument called a sampling machine or sampler.

Referring to FIG. 1, during generation and storage of sound source data, an analog audio signal of a sound which is to be a source is supplied from an input terminal 121 via a preamplifier 122 and a lowpass filter 123 to an A/D convefter 124 where it is converted into a serial 16-bit-per-sample data signal Sd at a sampling frequency of 31.5 kHz. This signal Sd is processed by a digital signal processor (DSP) 125 and thereby turn out to be sound source data which are stored in a memory 126.

The memory 126 has an address section of 2M words, for example, with an area of 512K words thereof being, for example, a 16 bit/address buffer area and with the remaining area of 1.5M words being, for example, a 12-bit/address storage area for storing the signals Sd.

The DSP 125 performs an arithmetic operation, using the buffer area of the memory 126, whereby the amplitude of the signal Sd is corrected or normalized so that the amplitude of the signal Sd becomes constant and represents a full range with respect to the aforementioned 12 bits. The 12-bit signal Sd thus obtained after correction is stored in a portion of a storage area of the memory 126.

At this time, parameters such as constants used for corrected the signal Sd, and parameters such as top and end addresses, used when storing the signal Sd in the memory 126, are transmitted from the DSP 125 to an 8-bit central processing unit (CPU) 111 of the aforementioned sound source unit, so as to be stored in a random access memory (RAM) 113 for work areas and parameters. The second source unit has a read-only memory (ROM) 112 in which a system control program is written and stored. The RAM 113 and the ROM 112 are connected over a bus line 119 to the CPU 111.

In this manner, the waveforms of, for example, 32 kinds of musical sounds, normalized to a predetermined amplitude, are stored in the memory 126, whereas the parameters concerning these waveforms are stored in the RAM 113.

On the other hand, on actuation of a keyboard 114 for MIDI standard, for reproducing the sound source data such as for editing or musical performance, the corresponding parameters are taken out by the CPU 111 from the RAM 113 in accordance with the setting of an operating panel 115 and are transmitted to the DSP 125, whereby the digital signal Sd of the corresponding waveform is taken out from the memory 126. However, the signal Sd thus taken out is yet a 12-bit-per sample signal and has its amplitude normalized to a constant value. The sampling frequency of the signal Sd is still 31.5 kHz as at the time it was stored. The keyboard 114 and the operating panel 115 are connected via an interface 116 to a bus line 119 to which a display panel 118 is connected via a driver 117.

In this case, when the original sound is longer than the storage period, the signal Sd is only of the duration of the storage period, so that a predetermined portion of the period towards the end of the signal Sd is repeated. Since the amplitude of the signal Sd has been corrected to the constant value, so step in amplitude is produced at the repetitive junction points of the signal Sd.

The signal Sd is supplied to a pitch converter 131, while tone data are taken out by key actuation on the keyboard 114 and are transmitted to the converter 131 via the CPU 111 and the DSP 125.

The converter 131 has an interpolating FIR digital filter, whereby the signal Sd is subject to, for example, 256-ple oversampling followed by resampling. In this manner, the pitch or interval of the analog signal at the time it was produced by conversion from the signal Sd is converted into the pitch or interval corresponding to the actuated key on the keyboard 114 without changing the sampling frequency of the signal Sd.

This signal Sd from the converter 131 is supplied to the DSP 132, while the corresponding parameters are taken out from the RAM 113 and supplied to the DSP 132 where the signal Sd is restored to its original bit length and re-corrected to the digital signal Sd for the original sound. On the other hand, the signal Sd is processed in the DSP 132 so that the attack, decay, sustain and release of the analog signal converted from the signal Sd will be in keeping with the operation on the operating panel 115.

In this manner, the digital signal Sd is taken out from the DSP 132, which signal has a constant frequency and has the pitch, the sound volume and timbre processed by the corresponding operation on the operating panel 115. This signal Sd is outputted at an output terminal 136 via a D/A converter 133, a low pass filter 134 and an output amplifier 135.

In this case, the signal Sd is taken out from the memory 126 and processed subsequently for musical performance on the time-sharing basis up to the maximum of 16 channels so that up to 16 voices or tones are outputted at the output terminal 136.

The foregoing is the basic operation of generating, storing and reproducing sound source data in an ordinary sampling sound source unit. Meanwhile, when the input audio signal is the sound from an ordinary musical instrument, it frequently has a fundamental frequency called the pitch. In this case, repetitive portions are contained in the waveform. One to several periods of the repetitive waveform portions are stored in the memory and repetitively reproduced to realize prolonged continuous reproduction of the musical sound. This is known as looping in the sampling sound source and is effective in saving the memory capacity. Another known effective technique for memory saving is data compression at the time of data recording and/or reproduction. In the present embodiment, a filter selection type data compressing technique is adopted, in which plural samples are grouped into a block and an optimum filter for data compression is selected with each such block as one unit.

Figure 2:
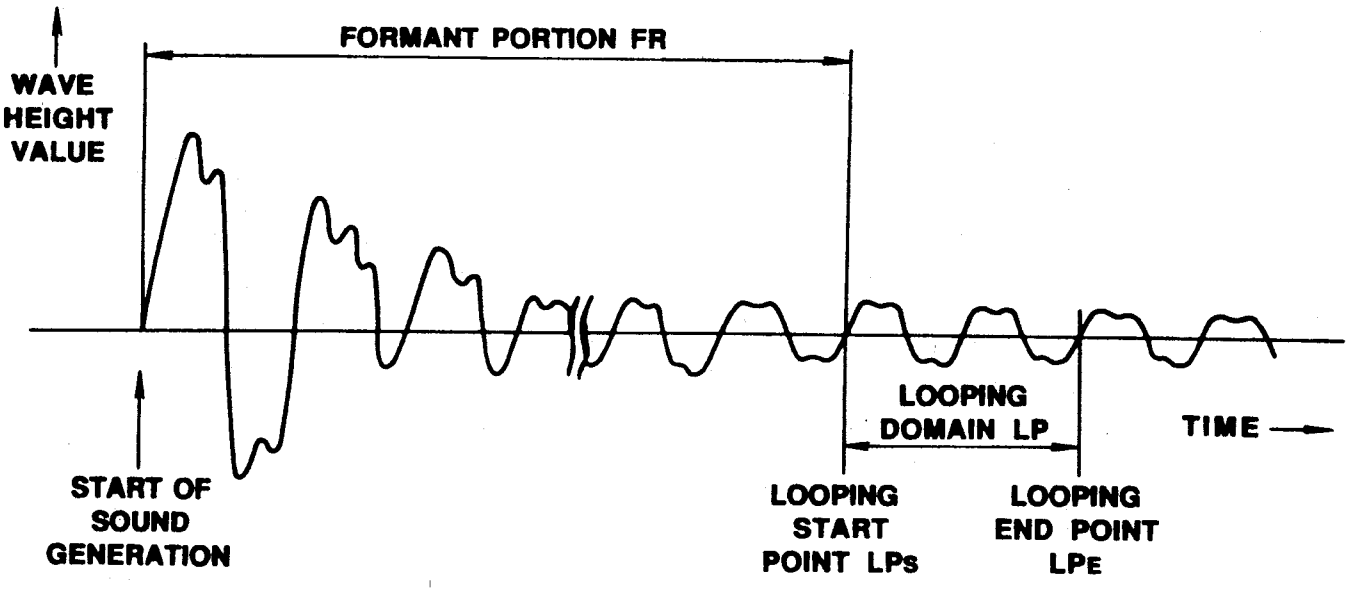
FIG. 2 is a waveform diagram for musical sound signals.

The above mentioned looping is explained briefly by referring to the waveform of the musical sound signal shown in FIG. 2. In general, directly after start of sound generation, a non-tone component, such as a noise of a key stroke in a piano or breath noise of a wind musical instrument, is contained in the waveform, and hence a format portion with inexplicit waveform periodicity is formed. After this formant portion, the same waveform starts to be repeated at a fundamental period corresponding to the pitch or interval of the musical sound. The n number of periods, n being an integer, of the waveform, are handled as a looping domain LP, which is defined between the looping start point $LP_S$ and the looping end point $LP_E$. By storing the formant portion FR and the looping domain LP on the recording medium and repeatedly reproducing the formant portion FR and the looping domain LP in this order at the time of reproduction, the musical sound may be generated for any desired time duration.

Turning now to FIGS. 3 to 20, generation of sound source data as well as the construction and the operation of the recording side system is explained in detail.

Figure 3:
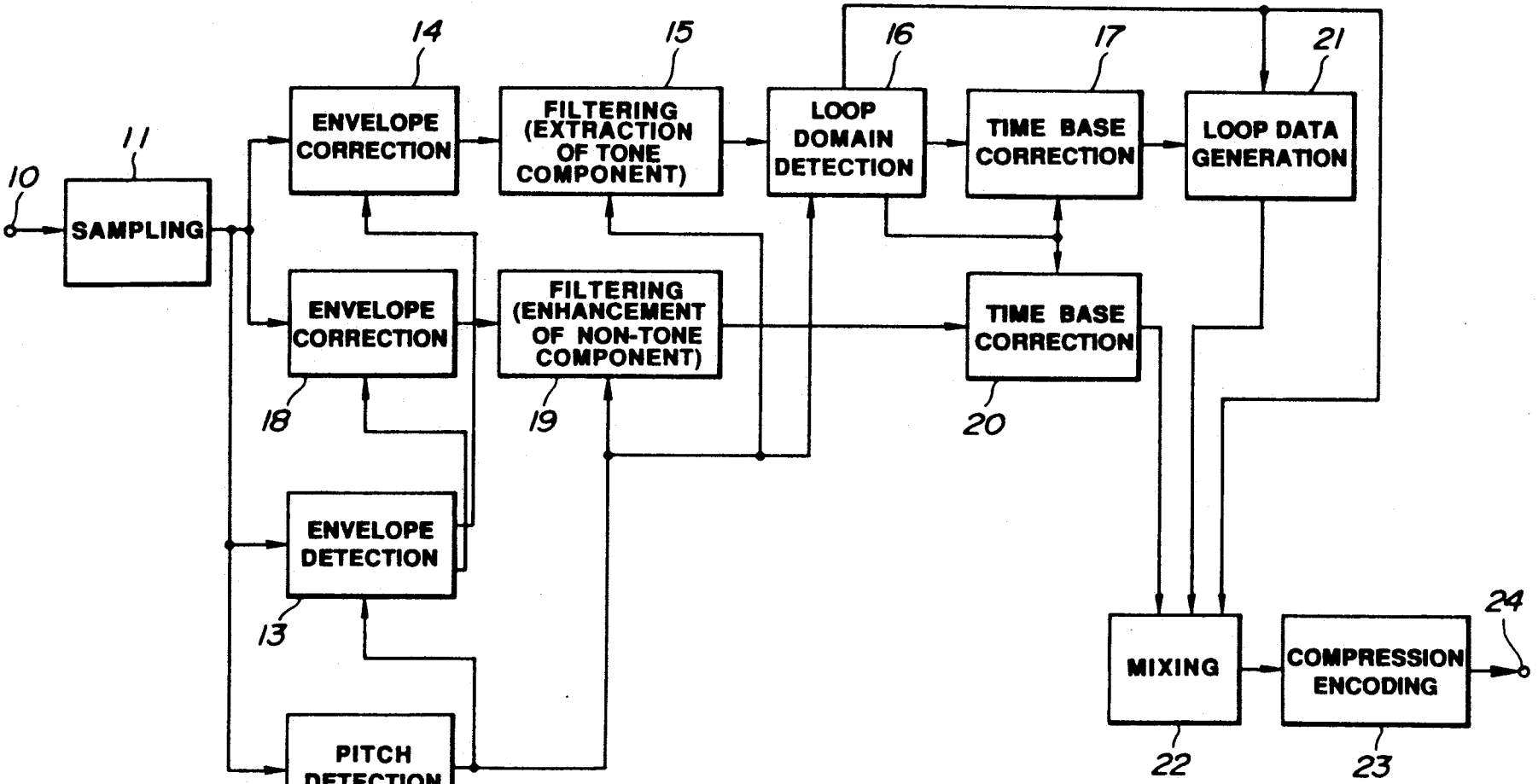
FIG. 3 is a functional block diagram according to an embodiment of the present invention.

FIG. 3 is a functional block diagram showing a practical example since the time of sampling until storage on a storage medium or memory of the input musical sound signal.

The input musical sound signal to the input terminal 10 may for example be a signal directly picked up by a microphone or a signal reproduced from a digital/audio signal recording medium as analog or digital signals.

Referring to FIG. 1, the input musical sound signal is sampled at a sampling block 11 at, for example, a frequency of 38 kHz, so as to be taken out as 16-bit-per-sample digital data. This sampling corresponds to A/D conversion for analog input signals and to sampling rate and bit number conversion for digital input signals.

Then, at a pitch detection block 12, the basic frequency, that is the frequency of a fundamental tone $f_0$ or the pitch data, which determines the sound height or pitch of the digital musical sound from the sampling block, is detected.

The principle of the detection at the detection block 12 is hereinafter explained. The musical sound signal as the sampling sound source occasionally has the frequency of the fundamental tone markedly lower than the sampling frequency fs so that it is difficult to identify the pitch with high accuracy by simply detecting the peak of the musical sound along the frequency axis. Hence it is necessary to utilize the spectrum of the harmonic overtones of the musical sound by some means or other.

The waveform f(t) of a musical sound, the pitch of which is desired to be detected, may be expressed by Fourier expansion by $$f(t) = \sum_{\omega} a(\omega)\cos[\omega t + \phi(\omega)] \quad (1)$$

where $a(\omega)$ and $\phi(\omega)$ denote the amplitude and the phase of each overtone component, respectively. If the phase shift $\phi(\omega)$ of each overtone is set to zero, the above formula may be rewritten to $$f(t) = \sum_{\omega} a(\omega)\cos\omega t \quad (2)$$

The peak points of the thus phase-matched waveform f(t) are at the points corresponding to integer multiples of the periods of all of the overtones of the waveform f(t) and at t=0. The peak at t=0 is no other than the period of the fundamental tone.

Figure 4:
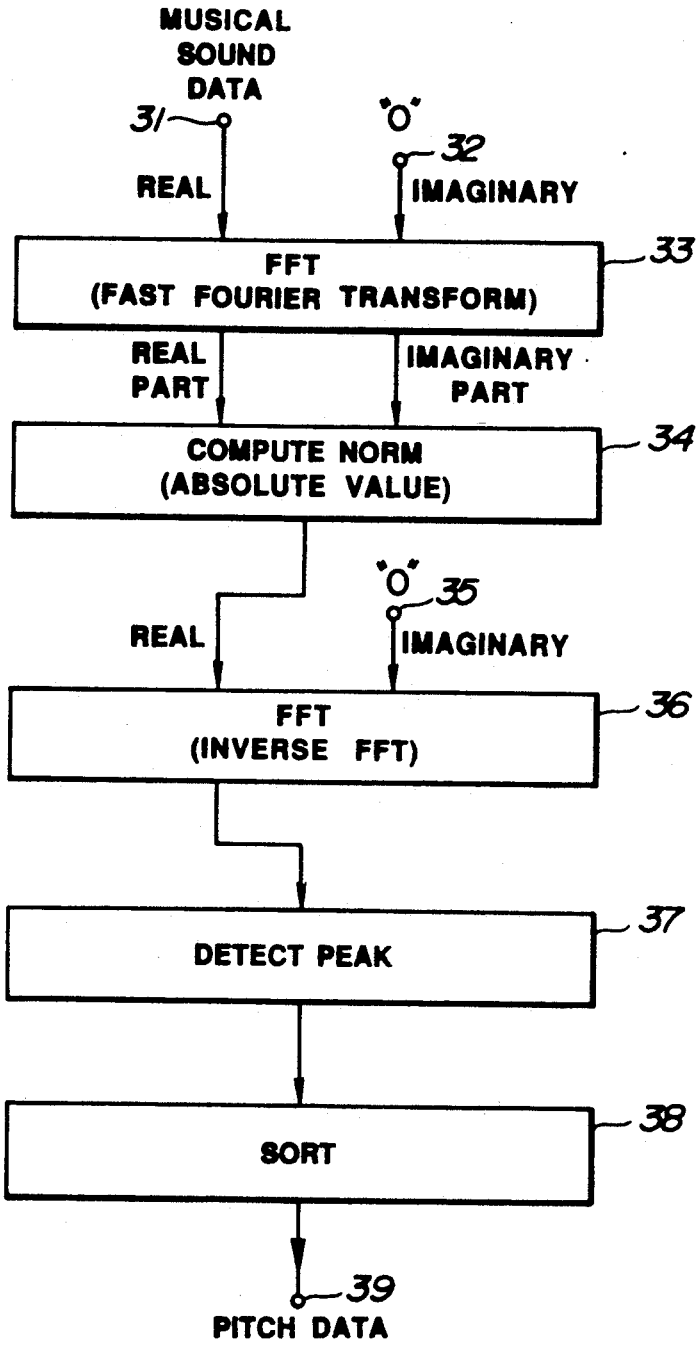
FIG. 4 is a functional block diagram for illustrating the pitch detection operation.

On the basis of this principle, the sequence of pitch detection is explained by referring to the functional block diagram of FIG. 4.

In this figure, musical sound data and "0" are supplied to a real part input terminal 31 and an imaginary part input terminal 32 of a fast Fourier transform (FFT) block 33, respectively.

In the Fourier transform, which is performed at the fast Fourier transform block 33, if the musical sound signal, the pitch of which is desired to be assumed, is expressed as x(t), and the harmonic overtone components in the musical sound signal x(t) is expressed as ps $$a_n\cos(2\pi f_n t + \theta) \quad (3)$$

x(f) may be given by $$x(t) = \sum_{n=0}^{\infty} a_n \cos(2\pi f_n t + \theta) \quad (4)$$

This may be rewritten by complex notation to $$x(t) = (1/2) \sum_{n=-\infty}^{\infty} a_n \exp(j\theta_n) \exp(j\omega_n t) \quad (5)$$

where on equation $$\cos\theta = (exp(j\theta) + exp(-j\theta))/2 \quad (6)$$

is employed. By Fourier transform, the following equation $$\begin{aligned} X(\omega) &= \int_{-\infty}^{\infty} x(t) \exp(-j\omega t) dt \\ &= \sum_{n=\infty}^{\infty} a_n \exp(j\theta_n) \delta(\omega - \omega_n) \end{aligned} \quad (7)$$

is derived, which $\delta(\omega - \omega_n)$ represents a delta function.

At the next block 34, the norm or absolute value, that is, the root of the sum of a square of the real part and a square of the imaginary part, of the data obtained after the fast Fourier transform, is computed.

Thus, by taking an absolute value $Y(\omega)$ of $X(\omega)$, the phase components are cancelled, so that $$\begin{aligned} Y(\omega) &= [X(\omega)\, X(\omega)]^{\frac{1}{2}} \\ &= (1/2) a_n \delta(\omega - \omega_n) \end{aligned} \quad (9)$$

This is made for phase matching of all of the high frequency components of the musical sound data. The phase components can be matched by setting the imaginary part to zero.

The thus computed norm is supplied as real part data to a fast Fourier transform block (in this case an inverse FFT block) 36 as the real part data, while "0" is supplied to an imaginary data input terminal 35, to execute an inverse FFT to restore the musical sound data. This inverse FFT may be represented by $$\begin{aligned} y(t) &= (1/2\pi) \int_{-\infty}^{\infty} Y(\omega) \exp(-j\omega t) dt \\ &= \int_{-\infty}^{\infty} a_n \cos\omega_n t \end{aligned} \quad (10)$$

The musical sound data, thus recovered after inverse FFT, are taken out as a waveform represented by the synthesis of cosine waves having the phase-matched high frequency components.

The peak values of the thus restored sound source data are detected at the peak detection block 37. The peak points are the points at which the peaks of all of the frequency components of the musical sound data become coincident. At the next block 38, the thus detected peak values are sorted in the order of the decreasing values. The pitch of the musical sound signal can be known by measuring the periods of the detected peaks.

Figure 5:
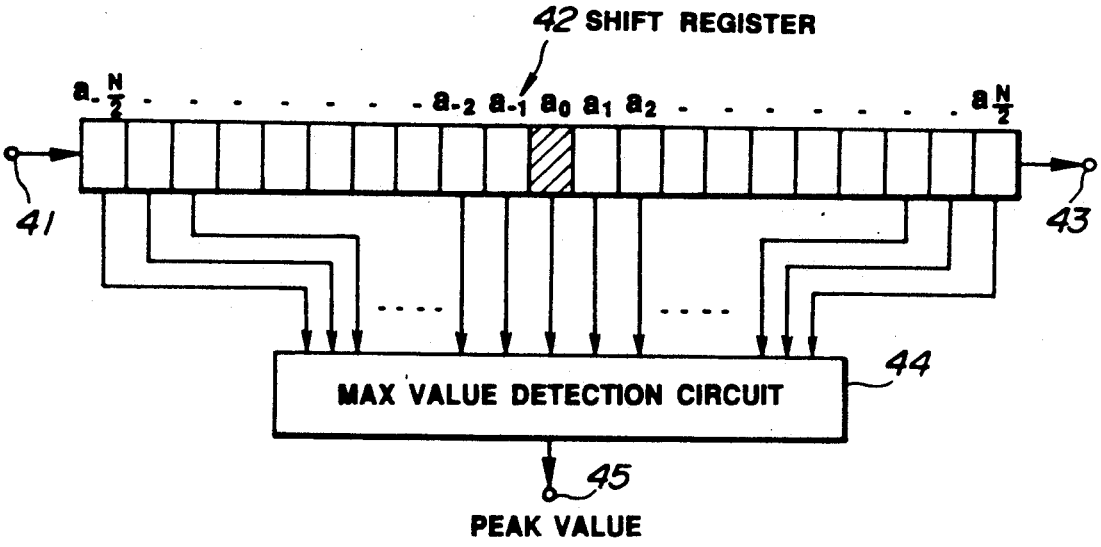
FIG. 5 is a block diagram for illustrating the pitch detection.

FIG. 5 illustrates an arrangement of the peak detection block 37 for detecting the maximum value or peak of the musical sound data.

It will be noted that a large number of peaks with different values are present in the musical sound data, and the pitch of the musical sound can be grasped by finding the maximum value of the musical sound data and detecting its period.

Referring to FIG. 5, the musical sound data string following the inverse Fourier transform is supplied via an input terminal 41 to a (N+1) stage shift register 42 and transmitted via registers $a_{-N/2}, \ldots, a_0, \ldots, a_{N/2}$ in this order to an output terminal 43. This (N+1) stage shift register 42 acts as a window having the width of (N+1) samples with respect to the musical sound data string and the (N+1) samples of the data string are transmitted via this window to a maximum value detection circuit 44. That is, as the musical sound data are first entered into the register $a_{-N/2}$ and sequentially transmitted to the register $a_{N/2}$, the (N+1) sample musical sound data from the register $a_{-N/2}, \ldots, a_0, \ldots, a_{N/2}$ are transmitted to the maximum value detection circuit 44.

This maximum value detection circuit 44 is so designed that, when the value of the central register $a_0$ of the shift register 42, for example, has turned out to be maximum among the values of the (N+1) samples, the circuit 44 detects the data of the register $a_0$ as the peak value to output the detected peak value at an output terminal 45. The width (N+1) of the window can be set to a desired value.

Turning again to FIG. 3, the envelope of the sampled digital musical sound signal is detected at envelope correction block 13, using the above pitch data, to produce the envelope waveform of the musical sound signal. This envelope waveform is obtained by sequentially connecting the peak points of the musical sound signal waveform, as shown at B in FIG. 6, and indicates the change in sound level or sound volume with lapse of time since the time of sound generation. This envelope waveform is usually represented by parameters such as ADSR, ar attach time/decay time/sustain level/release time. Considering the case of a piano tone, produced upon striking a key, as an example of the musical sound signal, the attack time $T_A$ indicates the time which elapses since a key on a keyboard is struck (key-on) until the sound volume increases gradually and reaches the target or desired sound volume value, the decay time $T_D$ the time which elapses since reaching the sound volume of the attack time $T_S$ until reaching the next sound volume, for example, the sound volume of a sustained sound of the piano, the sustain level $L_S$ the volume of the sustained sound that is kept since releasing key stroke until key-off and the release time $T_R$ the time which elapses since key-off until extinction of the sound. The times $T_A$, $T_D$ and $T_R$ occasionally indicate the gradient or rate of change of sound volume. Other envelope parameters than these four parameters may also be employed.

It will be noted that, at the envelope detection block 13, data indicating the overall decay rate of the signal waveform are obtained simultaneously with the envelope waveform data represented by the parameters such as the above mentioned ADSR in order to take out the formant portion with the residual attack waveform. These decay rate data assume a reference value "1" since the time of sound generation at key-on during the attack time $T_A$ and are then decayed monotonously, as shown for example in FIG. 7.

Figure 8:
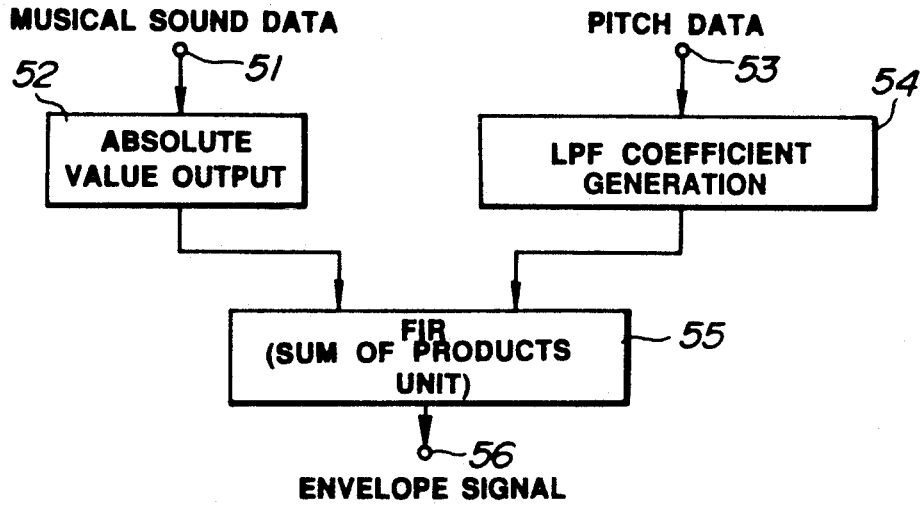
FIG. 8 is a functional block diagram for illustrating the envelope detecting operation.

An example of the envelope detection block 13 of FIG. 3 is explained by referring to the block diagram of FIG. 8.

The principle of envelope detection is similar to that of envelope detection of an amplitude modulated (AM) signal. That is, the envelope is detected with the pitch of the musical sound signal being considered as the carrier frequency for the AM signal. The envelope data are used when reproducing the musical sound, which is formed on the basis of the envelope data and pitch data.

The musical sound data supplied to the input terminal 51 of FIG. 8 is transmitted to an absolute value output block 52 to find the absolute value of the wave height data of the musical sound. These absolute value data are transmitted to an infinite inpulse response (FIR) type digital filter block or FIR block 55. This FIR block acts as a low pass filter, the cut-off characteristics of which are determined by supplying to the FIR block 55 a filter coefficient previously formed in a coefficient block 54 on the basis of the pitch data supplied to an input terminal 53.

Figure 9:
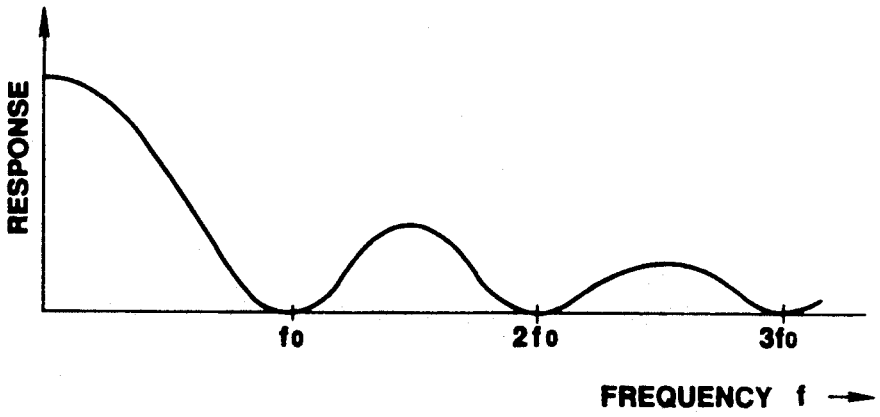
FIG. 9 is a chart showing FIR filter characteristics.

The filter characteristics are shown in FIG. 9 as an example and have zero points at the frequencies of the fundamental tone (at a frequency $f_0$) and harmonic overtones of the musical sound signal. For example, the envelope data as shown at B in FIG. 6 may be detected from the musical sound signal shown at A in FIG. 6 by attenuating the frequencies of the fundamental tone and the overtones by the FIR filter. The filter coefficient characteristics are shown by the formula $$H(f)=k\cdot(\sin(\pi f/f_0))/f \qquad (11)$$

where $f_0$ indicates the fundamental frequency or pitch of the musical sound signal.

The operation of generating the wave height signal data of the formant portion FR and the wave height signal data of the looping domain LP or looping data from the wave height value data of the sampled musical sound signal or sampling data is explained.

Figure 6:
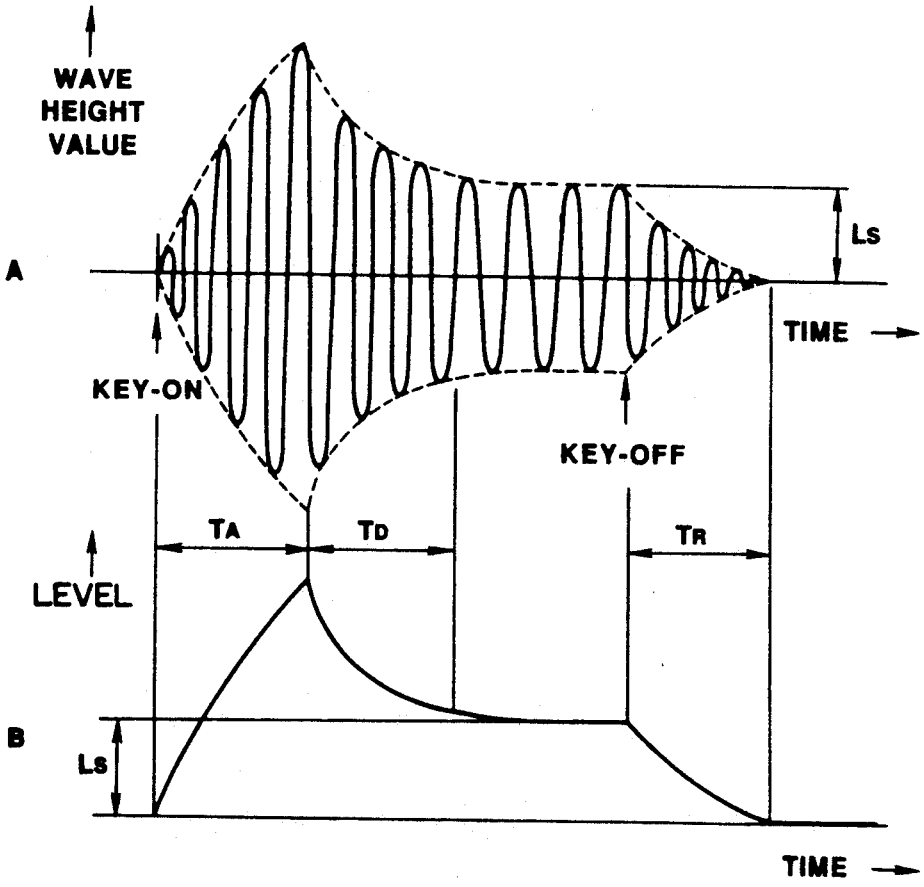
FIG. 6 is a waveform diagram of musical sound signals and the envelope.
Figure 7:
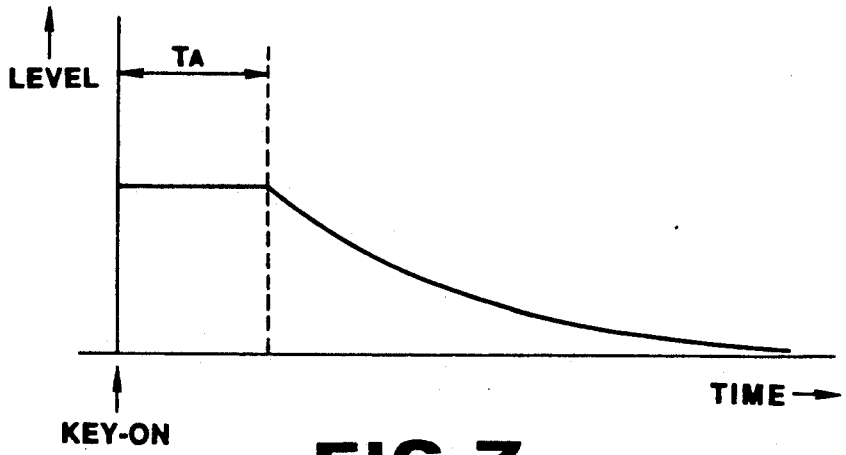
FIG. 7 is a waveform diagram showing the decay rate data for musical sound signals.
Figure 10:
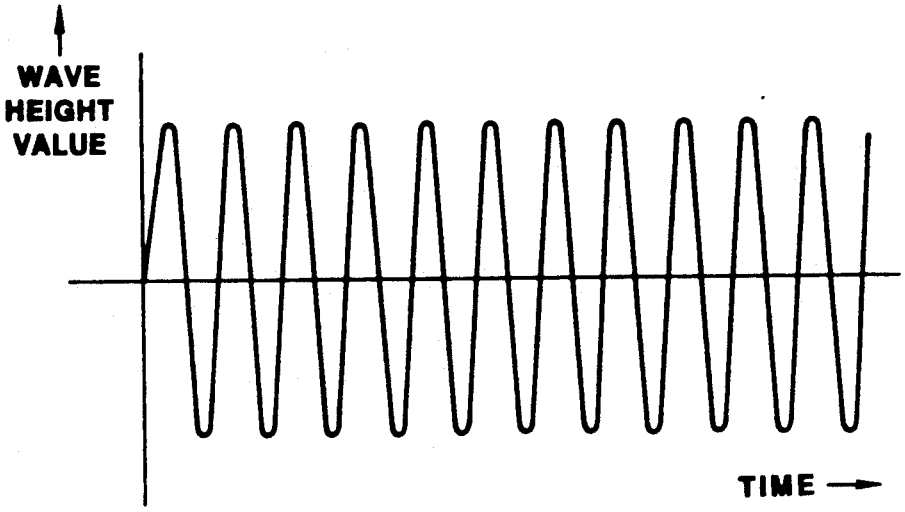
FIG. 10 is waveform diagram showing wave height value data after envelope correction of the musical sound signals.

In a first block 14 for generating the looping data, the wave height value data of the sampled musical sound signal are divided by data of the previously detected envelope waveform shown at B in FIG. 6 (or multiplied by its reciprocal) to perform an envelope correction to produce signal wave height value data of a waveform having a constant amplitude as shown in FIG. 10. This envelope corrected signal or, more precisely, the corresponding wave height value data, is filtered to produce a signal or, more precisely, the corresponding wave height value data, which is attenuated at other than the tone components, or which by comparison is enhanced at the tone components. The tone components herein means the frequency components that are integer multiples of the fundamental frequency $f_0$. More specifically, the data is passed through a high pass filter (HPF) to remove the low frequency components, such as vibrato, contained in the envelope corrected signal, and thence through a comb filter having frequency characteristics shown by a chain-dotted line in FIG. 11, that is the frequency characteristics having the frequency bands that are integer multiples of the fundamental frequency $f_0$ as the pass bands, to pass only the tone components contained in the HPF output signal, as well as to attenuate non-tone components or noise components. The data is also passed through a low pass filter (LPF) if necessary to remove noise components superimposed on the output signal from the comb filter.

Figure 11:
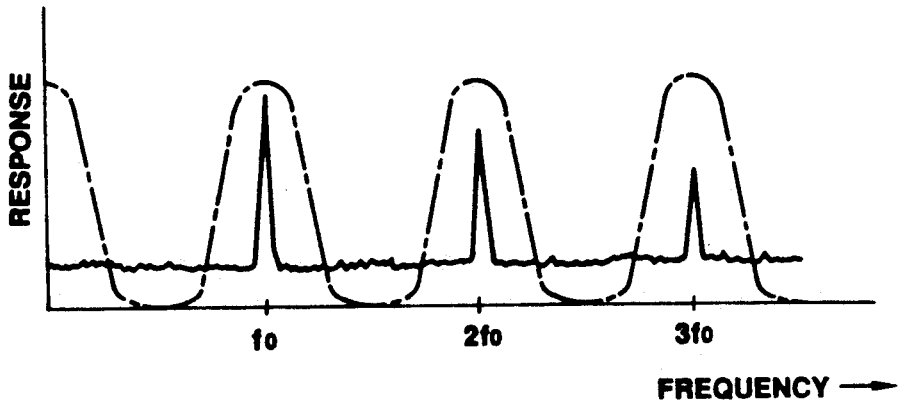
FIG. 11 is a chart showing comb filter characteristics.

That is, considering a musical sound signal, such as the sound of a musical instrument as the input signal, since the musical sound signal usually has a constant pitch or sound height, it has such frequency characteristics in which, as shown by a solid line in FIG. 11, energy concentration occurs in the vicinity of the fundamental frequency $f_0$ corresponding to the pitch of the musical sound and its integer multiple frequencies. Conversely, the noise components in general are known to have a uniform frequency distribution. Therefore, by passing the input musical sound signal through a comb filter having frequency characteristics shown by a chain-dotted line in FIG. 11, only the frequency components that are integer multiples of the fundamental frequency $f_0$ of the musical sound signal, that is, the tone components, are passed or enhanced, whereas other components or non-tone components or a portion of the noise are attenuated, so that the S/N ration is improved. The frequency characteristics of the comb-filter shown by a chain-dotted line in FIG. 11 may be represented by the formula $$H(f)=[(\cos(2\pi f/f_0)+1)/2]^N \qquad (12)$$

wherein $f_0$ indicates the fundamental frequency of the input signal, or the frequency of the fundamental tone corresponding to the pitch, and N the number of stages of the comb filter.

The musical sound signal having the noise component reduced in this manner is supplied to the repetitive waveform extracting circuit in which the musical sound signal is freed of the suitable repetitive waveform domain, such as the looping domain Lp, shown in FIG. 2 and supplied to and recorded on the recording medium, such as the semiconductor memory. The musical sound signal data recorded on the storage medium has the non-tone component and a part of the noise component attenuated so that the noise at the time of repetitive reproduction of the repetitive waveform domain or the looping noise may be reduced.

The frequency characteristics of the HPF, the comb filter and the LPF are set on the basis of the basic frequency $f_0$ which is the pitch data detected at the pitch detection block 12.

Then, at the looping domain detection block 16 of FIG. 3, a suitable repetitive waveform domain of the musical sound signal having the components other than the pitch component attenuated by the above mentioned filtering is detected to establish the looping points, that is, the looping start point $LP_S$ and the looping end point $LP_E$.

In more detail, at the detection block 16, the looping points are selected which are distant from each other by an integer multiple of the repetitive period corresponding to the pitch of the musical sound signal. The principle of selecting the looping points is hereinafter explained.

When looping musical sound data, the looping interval must be an integer multiple of the fundamental period which is a reciprocal of the frequency of the fundamental tone. Thus, by accurately identifying the pitch of the musical sound, the looping interval or distance can be determined easily.

Thus the looping distance is previously determined, two points spaced apart from each other by the distance are taken out and the correlation or analogy of the signal waveform in the vicinity of the two points is evaluated to establish the looping points. A typical evaluation function employing convolution or sum of products with respect to the samples of the signal waveform in the vicinity of the above two points is now explained. The operation of convolution is sequentially performed with respect to the sets of all points to evaluate the correlation or analogy of the signal waveform. In the evaluation by convolution, the musical sound data are sequentially entered to a sum of products unit formed by, for example, a digital signal processing unit (DSP) as later described, and the convolution is computed at the sum of products unit and outputted. The set of two points at which the convolution becomes maximum is adopted as the looping start point $LP_S$ and the looping end point $LP_E$.

Figure 12:
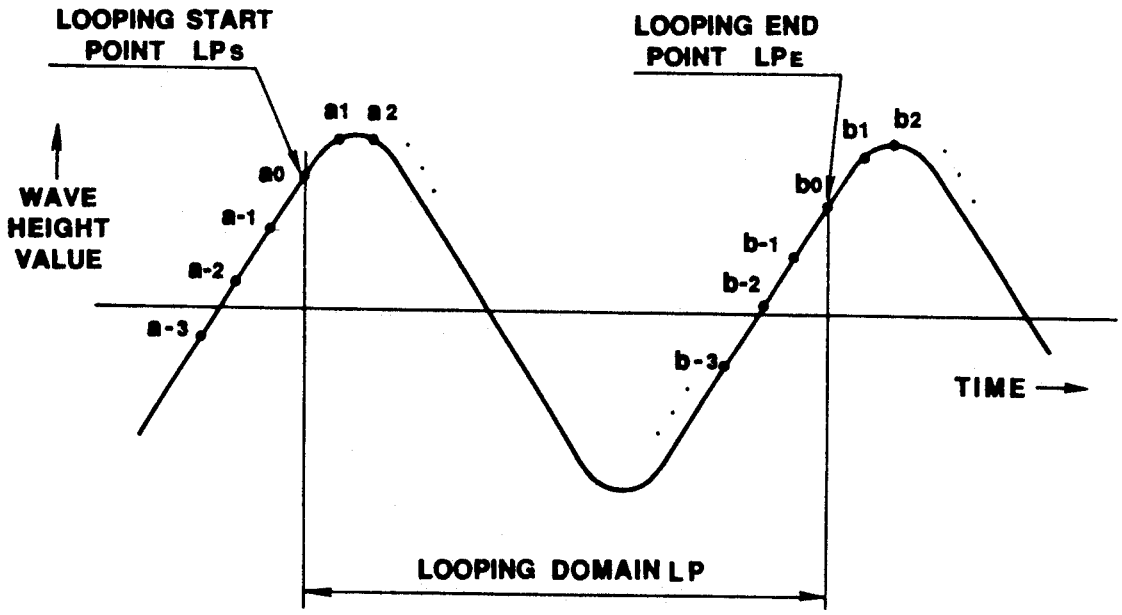
FIG. 12 is a waveform diagram for illustrating the optimum looping point setting operation.

In FIG. 12, with a candidate point $a_0$ of the looping start point $LP_S$, a candidate point $b_0$ for the looping end point $CP_E$, wave height data $a_{-N} \ldots, a_{-2}, a_{-1}, a_0, a_1, a_2, \ldots a_N$ at plural points, such as (2N+1) points, before and after the candidate point $a_0$ of the looping start point $LP_S$ and with wave crest height $b_{-N}, \ldots, b_{-2}, b_{-1}, b_0, b_1, b_2, \ldots, b_N$ at the same number (2N+1) of points before and after the candidate point $b_0$ of the looping end point $LP_E$, the evaluation function $E(a_0, b_0)$ at this time is determined by the formula $$E(a_0,b_0) = \left(\sum_{k=-N}^{N} a_k b_k\right)^2 \Big/ \left(\sum_{k=-N}^{N} a_k^2 \sum_{k=-N}^{N} b_k^2\right) \quad (13)$$

the convolution at or about the points $a_0$ and $b_0$ as the center is to be found from the formula (13). The sets of the candidates $a_0$ and $b_0$ are sequentially changed to find all the looping point candidates and the points for which the evaluation function E becomes maximum are adopted as the looping points.

The minimum square error method may also be used to find the looping points besides the convolution method. That is, the candidate points $a_0$, $b_0$ for the looping points by the minimum error square method may be expressed by the formula (14)

$$\epsilon(a_0,b_0) = \sum_{k=-N}^{N} (a_k - b_k)^2 \quad (14)$$

In this case, it suffices to find the points $a_0$, $b_0$ for which the evaluation function $\epsilon$ becomes minimum.

On the other hand, the pitch conversion ratio is computed in the loop domain detection block 16 on the basis of the looping start point $LP_S$ and the looping end point $LP_E$. This pitch conversion ratio is used as the time base correction data at the time of the time base correction at the next time base correction block 17. This time base correction is performed for matching the pitches of the various sound source data when these data are stored in storage means such as the memory. The above mentioned pitch data detected at the pitch detection data may be used in lieu of the pitch conversion ratio.

The pitch normalization in the block 17 is explained by referring to FIGS. 13A-14B.

Figure 13A:
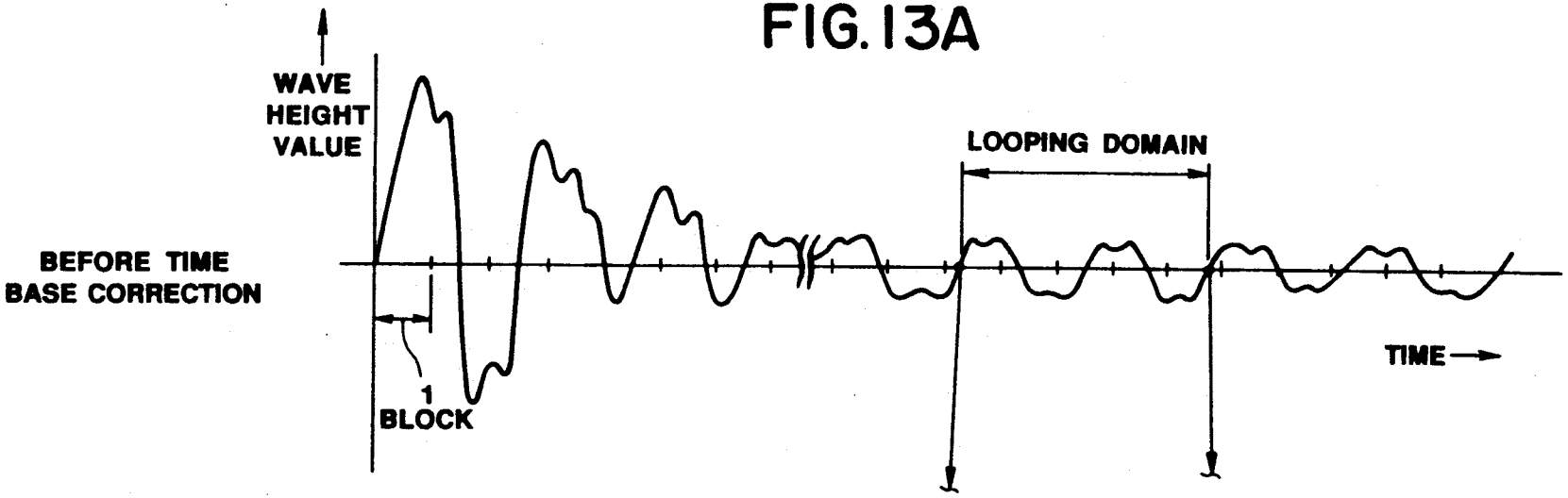
FIGS. 13A–13B are waveform diagrams showing the musical sound signals before and after time base correction.

FIGS. 13A and B show the musical sound signal waveform before and after time base companding, respectively. The time axes of FIGS. 13A and B are graduated by blocks for quasi-instantaneous bit compressing and encoding as later described.

Figure 13B:
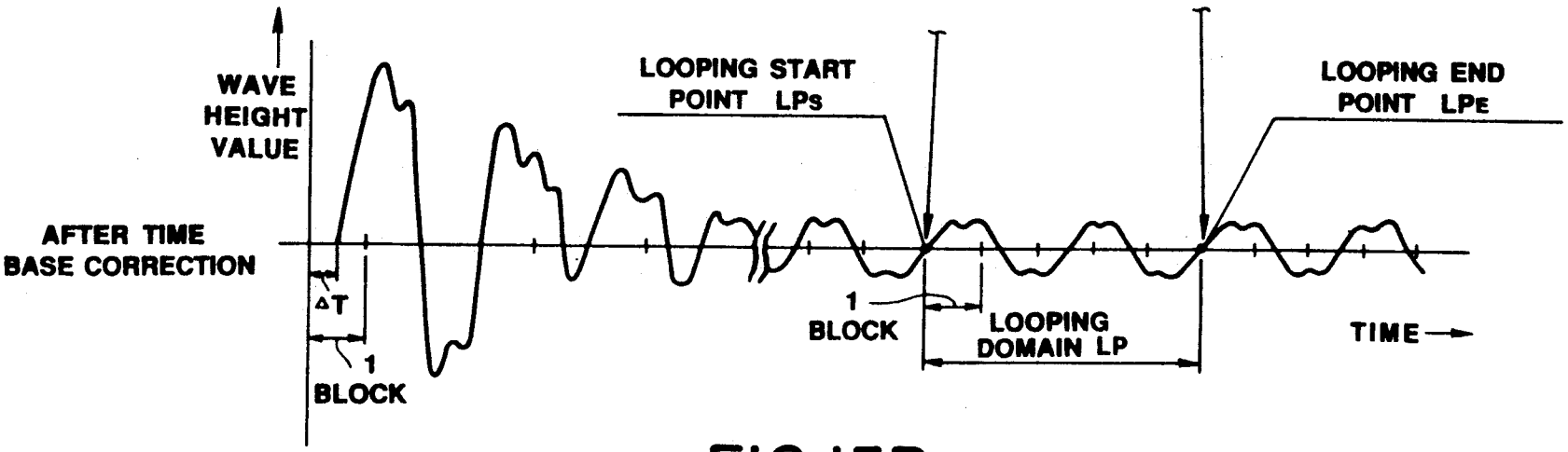
Figure 14A:
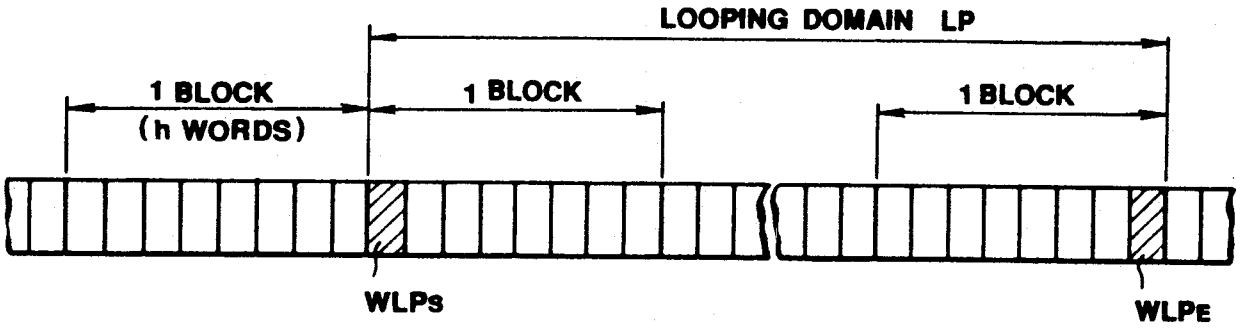
FIGS. 14A–14B are diagrammatic views showing the construction of the quasi-instantaneous bit compression block for wave height value data after time base correction.
Figure 14B:
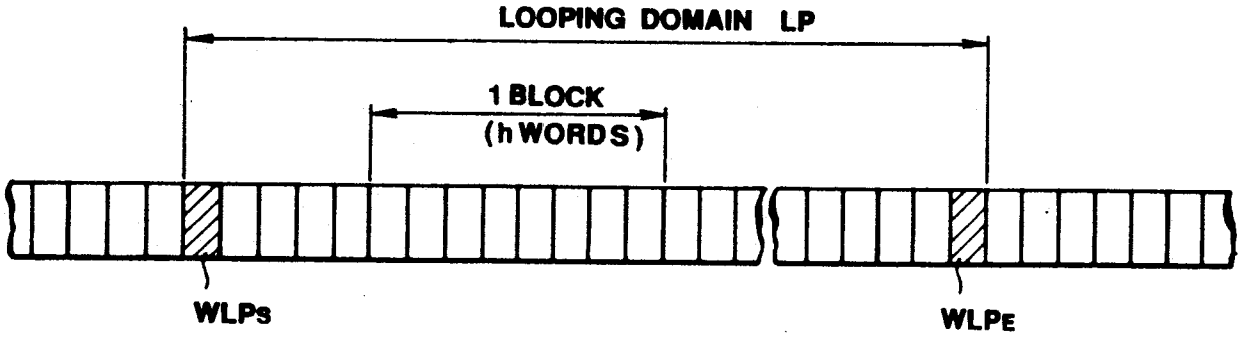

In the waveform A before time base correction, the looping domain LP is usually not related with the block. In FIG. 13B, the looping domain LP is time base companded so that the looping domain LP is an integral number multiple (m times) of the block length or block period. The looping domain is also shifted along time axis so that the block boundary coincides with the looping start point $LP_S$ and the looping end point $LP_E$. In other words, by performing time base correction, that is, the time base companding and shifting, so that the start point $LP_S$ and the end point $LP_E$ of the looping domain LP will be at the boundary of predetermined blocks, looping can be performed for an integer (m) of blocks for realizing pitch normalization of the sound source data at the time of recording. Wave height data "0" may be inserted in a offset $\Delta T$ from the block boundary of the leading end of the musical sound signal waveform by such time shift. FIGS. 14A-14B shows the structure of a block for the wave height value data of the waveform after time base correction which is subjected to bit compression and encoding as later described. The number of wave height value data for one block (number of samples or words) is h. In this case, pitch normalization consists in time base companding whereby the number of words within n periods of the waveform having a constant period $T_W$ of the musical sound signal waveform shown in FIG. 2, that is, within the looping period LP, will be an integer multiple (m times) of the number of words h in the block. More preferably, the pitch normalization consists in time base processing (shifting) for coinciding the start point $LP_S$ and the end point $LP_E$ of the looping domain $L_P$ with the block boundary positions on the time axis. When the points $LP_S$, $LP_E$ coincide in this manner with the block boundary positions, it becomes possible to reduce errors caused by block switching at the time of decoding by the bit compressing and encoding system.

Referring to FIG. 14A, words $WLP_S$ and $WLP_E$ each in one block indicate samples at the looping start point $LP_S$ and looping end point $LP_E$, more precisely, the point immediately before $LP_E$, for the corrected waveform. When the shifting is not performed, the looping start point $LP_S$ and the looping end points $LP_E$ are not necessarily coincident with the block boundary, so that, as shown in FIG. 14B, the words $WLP_S$, $WLP_E$ are set at arbitrary positions within the blocks. However, the number of words from the word $WLP_S$ to the word $WLP_E$ is an m number of times of the number of words h in one block, m being an integer, for normalizing the pitch.

The time base companding of the musical signal waveform whereby the number of words within the looping domain LP is equal to an integer multiple of the number of words h in one block, may be achieved by various methods. For example, it may be achieved by interpolating the wave height value data of the sampled waveform, with the use of a filter for oversampling.

Meanwhile, when the looping period of an actual musical sound waveform is not an integer number multiple of the sampling period such that an offset is produced between the sampling wave height value at the looping start point $LP_S$ and that at the looping end point $LP_E$, the wave height value coinciding with the sampling wave height value at the sampling start point $LP_S$ may be found in the vicinity of the looping end point $LP_E$, by interpolation with the use of, for example, oversampling, to realize the looping period which is not an integer multiple of the sampling period inclusive of the interpolating sample. Such looping period, which is not a integer multiple of the sampling period, may be set so as to be an integer multiple of the block period by the above described time base correcting operation. In case a time base companding is performed with the use of, for example, 256-ple oversampling, the wave crest value error between the looping start point $LP_S$ and the looping end point $LP_E$ may be reduced to 1/256 to realize more smooth looping reproduction.

Figure 15:
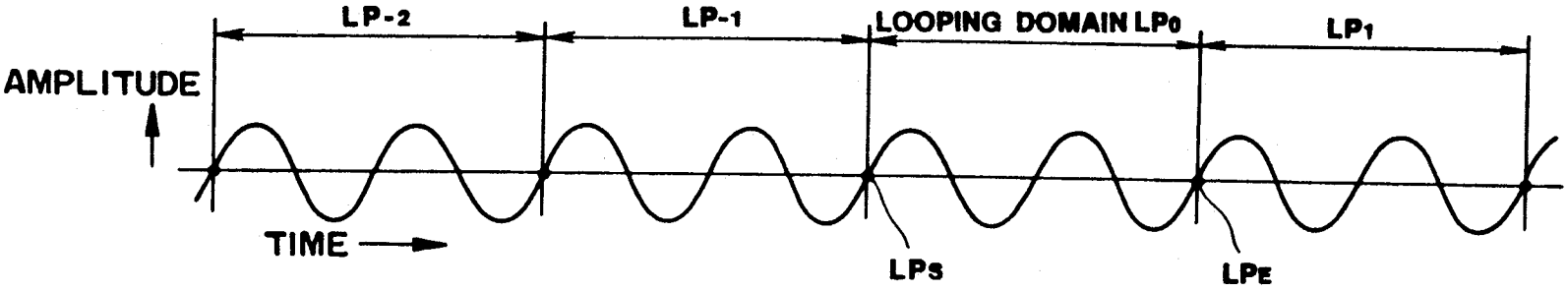
FIG. 15 is a waveform diagram showing loop data obtained by repeatedly interconnecting the waveforms of the looping domain.
Figure 16:
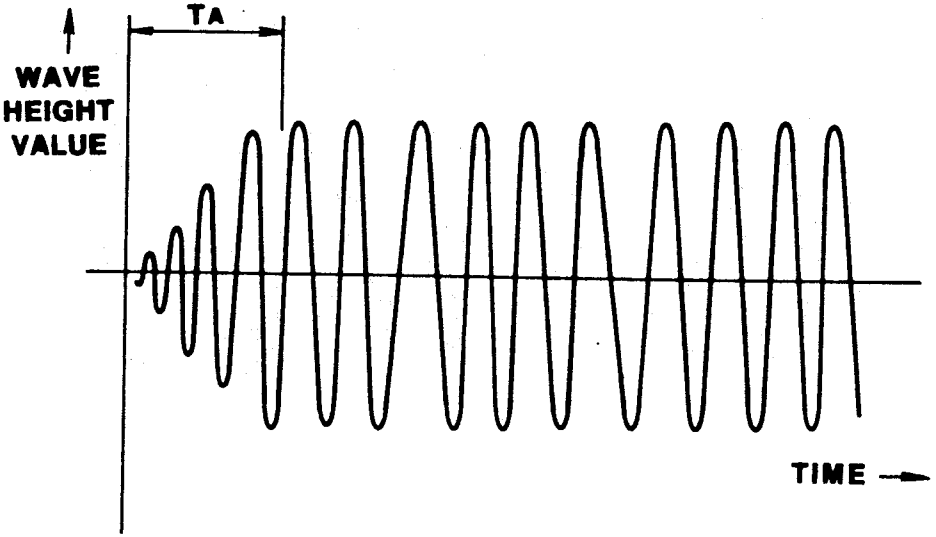
FIG. 16 is a waveform diagram showing data for forming a formant portion after envelope correction based on the decay rate data.

After the looping domain LP is determined and subjected to time base correction or companding as mentioned hereinabove, the looping domains LP are connected to one another as shown in FIG. 15 to produce looping data. FIG. 16 shows the loop data waveform obtained by taking out only the looping domain LP from the time base corrected musical sound waveform shown in FIG. 13B and arraying a plurality of such looping domains LP. The looping data waveform is obtained at a loop data generating block 21 by sequentially connecting the looping end points $LP_E$ of a given one of the looping domains LP with the looping start point $LP_S$ of another looping domain LP.

Since these loop data are formed by connecting the loop domains L a number of times, the start block including the word $WLP_S$ corresponding to the looping start point $LP_S$ of the loop data waveform is directly preceded by the data of the end block including the word $WLP_S$ corresponding to the looping end point $LP_E$, more precisely, the point immediately before the point $LP_E$. As a principle, in order for an encoding to be performed for bit compression and encoding, at least the end block must be present just ahead of the start block of the looping domain Lp to be stored. More generally, at the time of bit compressing and encoding on the block-by-block basis, the parameters for the start block, that is, data on bit compression and encoding for each compressed block, for example, ranging or filter selecting data as will be subsequently described, need only be formed on the basis of data of the start and the end blocks. This technique may be applied to the base wherein the musical sound consisting only of loop data and devoid of a format as subsequently described is used as the sound source.

By so doing, the same data are present over several samples before and after each of the looping start point $LP_S$ and the looping end point $LP_E$. Therefore, the parameters for bit compression and encoding in the blocks immediately preceding these points $LP_S$ and $LP_E$ are the same as that errors or noises at the time of looping reproduction upon decoding may be reduced. Thus the musical sound data obtained upon looping reproduction are stable and free of junction noises. In the present embodiment, about 500 samples of the data are contained in the looping domain LP just ahead of the starting block.

In the process of signal data generation for the formant portion FR, envelope correction is performed at the block 18, as at the block 14 used at the time of looping data generation. The envelope correction at this time is performed by dividing the sampled musical sound signal by the envelope waveform (FIG. 6) consisting only of the decay rate data to produce the wave height value data of the signal having the waveform shown in FIG. 17. Thus, in the output signal of FIG. 17, only the envelope of the attack portion during the time $T_A$ is left and other portions are of the constant amplitude.

The envelope corrected signal is filtered, if necessary, at the block 19. For filtering at the block 19, the comb filter having frequency characteristics shown for example by the chain dotted line in FIG. 11 is employed. This comb filter has such frequency characteristics that the frequency band components that are integer multiples of the fundamental frequency $f_0$ are enhanced and, by comparison, the non-tone components are attenuated. The frequency characteristics of the comb filter are also established on the basis of the pitch data (fundamental frequency $f_0$) detected at the pitch detection block 12. These data are used for producing signal data of the formant portion in the sound source data ultimately recorded on the storage medium, such as the memory.

In the next block 20, time base correction similar to that performed in the block 17 is performed on the formant portion generating signal. The purpose of this time base correction is to match or normalize the pitches for the sound sources by companding along the time base on the basis of the pitch conversion ratio found in the block 16 or the pitch data detected in the block 12.

In the mixing block 22, the formant portion generating data and the loop data corrected by using the same pitch conversion ratio or pitch data are mixed together. For such mixing, a Hamming window is applied to the formant portion generating signal from the block 20, a fade-out type signal decaying with time at the portion to be mixed with the loop data is formed. A similar Hamming window is applied to the loop data from the block 20, a fade-in type signal increasing with time at the portion to be mixed with the formant signal is formed and the two signals are mixed (or cross-faded) to produce a musical sound signal which will ultimately prove to be the sound source data. As the loop data to be stored in the storage medium such as memory, data of a looping domain spaced to some extent from the cross-faded portion may be taken out to reduce the noise during looping reproduction (looping noise). In this manner, wave height value data of a sound source signal consisting of the looping domain LP which is the repetitive waveform portion consisting only of the tone component and the formant portion FR which is a waveform portion containing non-tone components since the sound generation.

The starting point of the loop data signal may also be connected to the looping start point of the formant forming signal.

For detecting the looping domain, looping or mixing the formant portion and the loop data, rough mixing is performed by manual operation with trial hearing and more accurate processing is then performed on the basis of the data on the looping points, that is, the looping start point $LP_S$ and the looping end point $LP_E$.

That is, before precise loop domain detection at the block 16, loop domain detection and mixing as mentioned hereinabove is performed by manual operation with trial hearing in accordance with the procedure shown in the flow chart of FIG. 17, after which the above described high precision procedure is performed at step S26 et seq.

Figure 17:
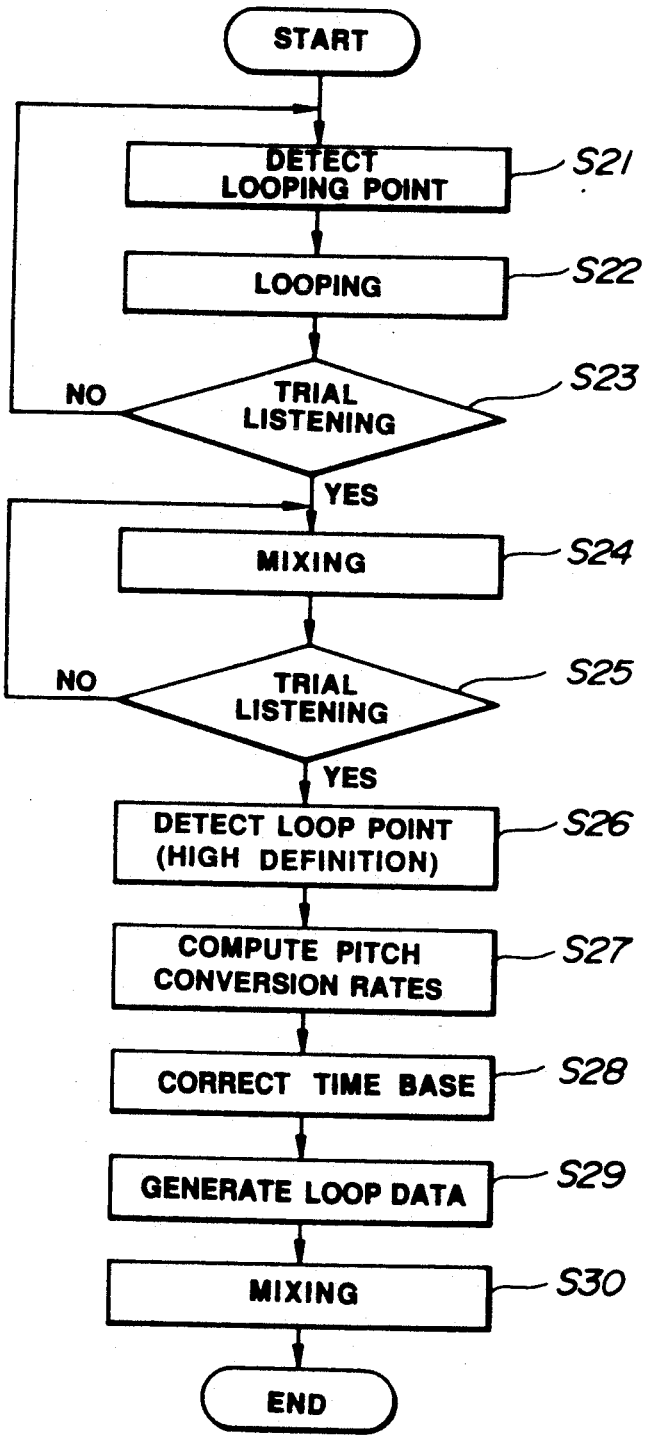
FIG. 17 is a flow chart for illustrating the operation before and after actual looping.

Referring to FIG. 17, the looping points are detected at step S21 with low precision by utilizing zero-crossing points of the signal waveform or visually checking the indication of the signal waveform. At step S22, the waveform between the looping points is repeatedly reproduced by looping. At step S23, it is checked by trial hearing whether the looping state is satisfactory. If other wise, the program reverts to step S21 to detect again the looping points. This operational sequence is repeated until a satisfactory result is obtained. If the result is satisfactory, the program proceeds to step S24 where the waveform is mixed such as by cross-fading with the formant signal. At the next step S23, it is decided by trial hearing whether the shift from the formant to the looping is satisfactory. If otherwise, the program reverts to step S24 for re-mixing. The program then proceeds to step S26 where the high precision loop domain detection at the block 16 is performed. In more detail, detection of the loop domain including the interpolated sample, for example, loop domain detection at the precision of 1/256 of the sampling period at the time of, for example, 256-ple oversampling, is performed. At the next step S27, the pitch conversion ratio for pitch normalization is computed. At the next step S28, time base correction of the blocks 17 and 20 is performed. At the next step S29, loop data generation at the block 21 is performed. At the next step S30, mixing at the block 22 is performed. The operations since step S26 are performed with the use of the looping points obtained by the steps S21 to S25. The steps S21 to S25 may be omitted for full automation of the looping.

The wave height value data of the signal consisting of the formant portion FR and the looping domain LP, obtained upon such mixing, are processed at the next block 23 by bit compression and encoding.

Although various bit compressing and encoding systems may be employed, a quasi-instant companding type high efficient encoding system, as proposed by the present Assignee in the JP Patent KOKAI Publications 62-008629 and 62-003516, in which a predetermined number of h-sample words of wave height value data are grouped in blocks and subjected to bit compression on the block-by-block basis in herein employed. This high efficiency bit compression and encoding system is now briefly explained by referring to FIG. 18.

In this figure, the bit compression and encoding system is formed by an encoder 70 at the recording side and a decoder 90 at the reproducing side. The wave height value data x(n) of the sound source signal is supplied to an input terminal 71 of the encoder 70.

The wave height value data x(n) of the input signal are supplied to a FIR type digital filter 74 formed by a predictor 72 and a summing point 73. The wave height value data x(n) of the prediction signal from the predictor 72 is supplied as a subtraction signal to the summing point 73. At the summing point 73, the prediction signal x(n) is subtracted from the input signal x(n) to produce a prediction error signal or a differential output d(n) in the broad sense of the term. The predictor 72 computes the predicted value x(n) from the primary combination of the past P number of inputs $x(n-p), x(n-p+1), \ldots, x(n-1)$. The FIR filter 74 is referred to hereinafter as the encoding filter.

With the above described high efficiency bit compression and encoding system, the sound source data occurring within a predetermined time, that is, input data each of a predetermined number h of words, are grouped into blocks, and the encode filter having optimum characteristics are selected for each block. This may be realized by providing a plurality of, four for example, having different characteristics, in advance, and selecting such one of the filters which has optimum characteristics, that is, which enables the highest compression ratio to be achieved. The equivalent operation may however be provided by storing a set of coefficients of the predictor 72 of the encode filter 74 shown in FIG. 18 in a plurality of, herein four, sets of coefficient memories, and time-divisionally switching and selecting one of the coefficients of the set.

The difference output d(n) as the predicted error is transmitted via summing point 81 to a bit compressor consisting of a gain G shifter 75 and a quantizer 76 where a compression or ranging is performed so that the index part and the mantissa part under the floating decimal point indication correspond to the gain G and the output from the quantizer 76, respectively. That is, a re-quantization is performed in which the input data is shifted by the shifter 75 by a number of bits corresponding to the gain G to switch the range and a predetermined number of bits of the bit shifted data is taken out via the quantizer 76. The noise shaping circuit 77 operates in such a manner that the quantization error between the output and the input of the quantizer 76 is produced at the summing point 78 and transmitted via a gain $G^{-1}$ shifter 79 to a predictor 80 and the prediction signal of the quantization error is fed back to the summing point 81 as a substraction signal (error feedback). After such re-quantization by the quantizer 76 and the error feedback by the noise shaping circuit 77, an output d(n) is taken out at an output terminal 82.

The output d'(n) from the summing point 81 is the difference output d(n) less the prediction signal e(n) of the quantization error from the noise shaping circuit 77, whereas the output d''(n) from the gain G shifter 75 is the output d'(n) from the output summing point 81 multiplied by the gain G. On the other hand, the output (n) from the quantizer 76 is the sum of the output d''(n) from the shifter 75 and the quantization error e(n) produced during quantization. The quantization error e(n) is taken out at the summing point 78 of the noise shaping circuit 77. After passing through the gain $G^{-1}$ shifter 79 and the predictor 80 taking the primary combination of the past r number of inputs, the quantization error e(n) is turned into the prediction signal e(n) of the quantization error.

After the above described encoding operation, the second source data is turned into the output (n) from the quantizer 76 and taken out at the output terminal 82.

From a predictor-range adaptor 84, mode selection data as the optimum filter selection data are outputted and transmitted to, for example, the predictor 72 of the encode filter 74 and an output terminal 87, and range data for determining the bit shift quantity or the gains G and $G^{-1}$ are also outputted and transmitted to shifters 75, 79 and 81 to an output terminal 86.

The input terminal 91 of the decoder 90 at the reproducing side is supplied with the output (n) from the output terminal 82 from the encoder 70 or the signal (n) obtained upon its recording or reproduction. This input signal d'(n) is supplied to a summing point 93 via a gain $G^{-1}$ shifter 92. The output x'(n) from the summing point 93 is supplied to a predictor 94 and thereby turned into a prediction signal x'(n), which then is supplied to the summing point 93 and summed to the output ''(n) from the shifter 92. This sum signal is outputted as a decode output '(n) at an output terminal 95.

The range data and the mode select signal outputted, transmitted, recorded or reproduced at the output terminals 86, 87 of the encoder 70 are entered to input terminals 96, 97 of the decoder 90. The range data from the input terminal 96 are transmitted to the shifter 92 to determine the gain $G^{-1}$, while the mode select data from the input terminal 97 are transmitted to a predictor 94 to determine prediction characteristics. These prediction characteristics of the predictor 94 are selected so as to be equal to those of the predictor 72 of the encoder 70.

With the above described decoder 90, the output "(n) from the shifter 92 is the product of the input signal '(n) by the gain $G^{-1}$. On the other hand, the output '(n) from the summing point 93 is the sum of the output "(n) from the shifter 72 and the prediction signal x'(n).

Figures 19, 20:
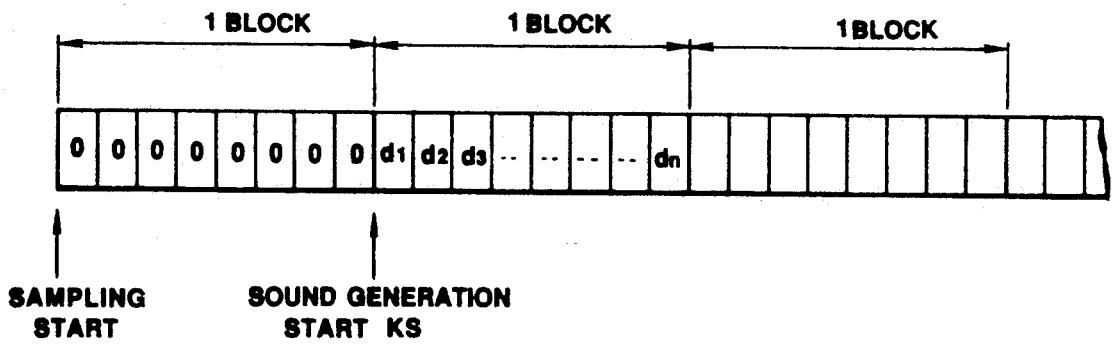
FIG. 19 is a schematic diagram showing an example of one block of data obtained by quasi-instantaneous bit compression.
FIG. 20 is a schematic diagram showing the contents of a block of a leading portion of musical sound signals.

FIG. 19 shows an example of one-block output data from the bit compressing encoder 70 which is composed of 1-byte header data (parameter data concerning compression, or sub-data) RF and 8-byte sampling data $D_{A0}$ to $D_{B3}$. The header data RF is made up of the 4-bit range data, 2-bit mode selection data or filter selection data and two 1-bit flag data, such as data LI indicating the presence or absence of the loop and data E1 indicating whether the end block of the waveform is negative. Each sample of the wave height value data is represented after bit compression by four bits, while 16 samples of 4-bit data $D_{AOH}$ to $D_{B3L}$ are contained in the data $D_{A0}$ to $D_{B3}$.

FIG. 20 shows each block of the quasi-instantly bit compressed and encoded wave height value data corresponding to the leading part of the musical sound signal waveform shown in FIG. 2. In FIG. 20, only the wave height value data are shown with the exclusion of the header. Although each block is formed by eight samples for simplicity of illustration, it may be formed by any other number of samples, such as 16 samples. This may also apply for the case of FIGS. 14A–14B.

The quasi-instantaneous bit compressing and encoding system selects one of the straight PCM mode of directly outputting the input musical sound signal, primary differential filter mode or secondary differential filter mode of outputting the musical sound signal by way of a filter, which will give signals having the highest compression ratio, to transmit musical sound data which is the output signal.

When sampling and recording a musical sound on a storage medium, such as a memory, the waveform of the musical sound starts to be fetched at a sound generation start point KS. When the primary or secondary differential filter mode in need of an initial value should be selected at the first block since the sound generation start point KS, it would be necessary to set the initial value in store. It is however desirable that such initial value may be dispensed with. For this reason, pseudo input signals which will cause the straight PCM mode to be selected are affixed during the period preceding the sound generation start point KS and signal processing is then performed so that these pseudo signals will also be processed.

More specifically, in FIG. 20, a block containing all "0" as the pseudo input signals is placed ahead of the sound generation start point KS and the data "0" from the leading part of the block art bit compressed and entered as the input signal. This may be achieved by providing a block containing all "0" bits and storing it in a memory, or by starting the sampling of the musical sound at the input signal containing all "0" bits ahead of the start point KS, that is, the silent part preceding the sound generation. At least one block of the pseudo input signal is required in any case.

Figure 18:
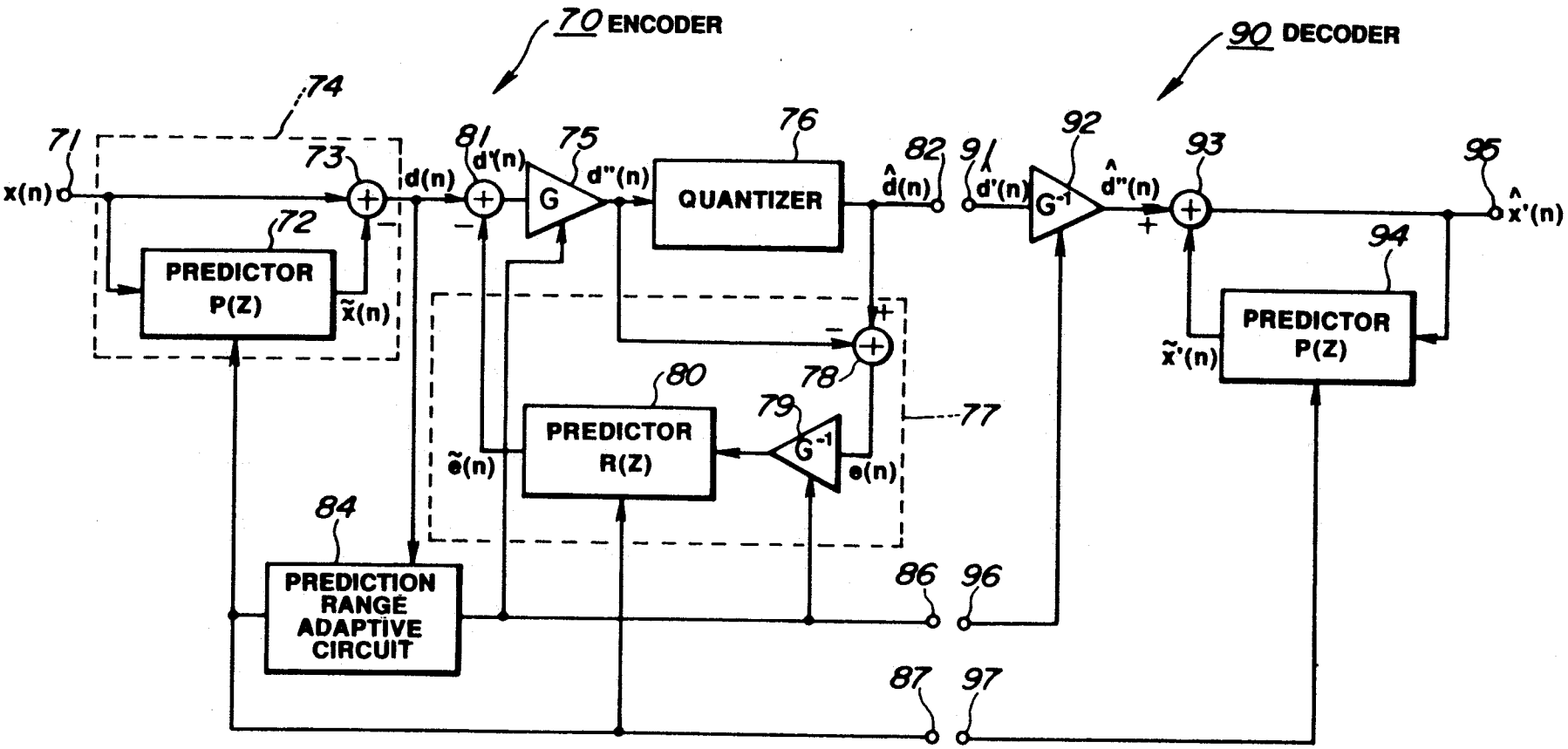
FIG. 18 is a block circuit diagram showing a schematic construction of the quasi-instantaneous bit compression encoding.

The musical sound data inclusive of the thus formed pseudo input signals are compressed by the high efficiency bit compression and encoding system shown in FIG. 18 and recorded in a suitable recording medium, such as a memory, and the thus compressed signal is reproduced.

Thus, when reproducing the musical sound data containing the pseudo input signal, the straight PCM mode is selected for the filter upon starting the reproduction of the block of the pseudo input signals, so that it becomes unnecessary to preset the initial values for the primary or secondary differential filters.

There is raised a problem concerning the delay in the sound generation start time by the pseudo input signal upon starting the reproduction, which signal is silent since the data are all zero. However, this is not inconvenient in that, with the sampling frequency of 32 kHz and with a 16-sample block, the delay in the sound generation is about 0.5 msec which cannot be discerned by the auditory sense.

Meanwhile, during formation of the looping data, continuity at the junction points of the looping waveform may be deteriorated due to coarseness of the sampling frequency as compared to the repetition period of the signal waveform.

Figure 21:
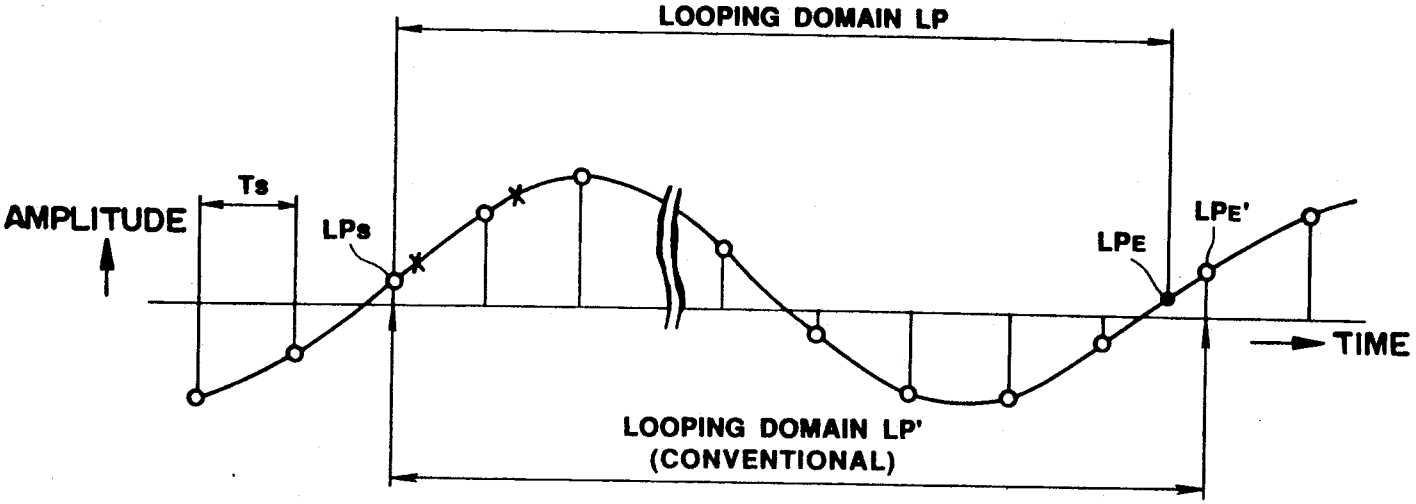
FIG. 21 is a waveform diagram for illustrating the connection samples at the looping points.

Referring to FIG. 21, a looping domain LP' corresponding to a repetitive waveform, which is obtained only from actual samples by sampling the signal waveform having a predetermined period (shown by circles), has actual samples at the looping start point $LP_S$ and at the looping end point $LP_E$. When connecting the looping start point $LP_S$ and the looping end point $LP_E'$, it is only on rare occasions that the starting point $LP_S$ has a wave height value close to the wave height value of the end point $LP_E'$, such that discontinuity is produced in many cases between the start point $LP_S$ and the end point $LP_E'$, as indicated by the connected waveform as shown by a solid line in FIG. 22. It is therefore preferred to interpolate the waveform data formed by the actual samples to generate interpolated samples to find the looping start $LP_S$ and the looping end point $LP_E$, inclusive of the points of the interpolated samples, which will have the closest wave height values to each other, and to use these points as the waveform junction points. This may be realized at the time base correction block 17 of the above mentioned embodiment to perform the pitch normalization at a time unit resolution shorter than the sampling period. If the pitch normalization is not performed, the aforementioned actual samples may be stored in a memory and an interpolating operation performed during data read-out or reproduction to produce interpolated samples to improve the waveform continuity.

When the waveform of a musical sound of the pitch of an occasionally pressed key on a keyboard is to be reproduced on the basis of a sound source data of a predetermined pitch stored in a memory of an ordinary sampling sound source device, or so-called sampler, it becomes necessary to effect pitch conversion for producing various pitch sounds. When an oversampling type interpolation system is used for this pitch conversion system, the above mentioned technical concept may be realized without increasing the hardware to produce interpolated samples. FIGS. 23A–23B illustrates the pitch conversion system by this interpolation, in which the take-out interval of the interpolation samples obtained upon, for example, quadruple oversampling, is changed to realize pitch conversion. In an example shown in FIGS. 23A–23B, every fifth sample is taken out from all the samples, composed of the actual samples, shown by circle marks, of the original waveform A, and interpolated samples, shown by X marks, produced by quadruple oversampling of each of the actual samples, and the samples thus taken out are arrayed at the original sampling period Ts to produce a pitch converted waveform B. In this case, the frequency is changed to 5/4 times the original frequency. Although the pitch is raised in the example shown in FIGS. 23A-23B, the pitch may also be lowered by taking out every third sample. The resolution may also be improved by increasing the number of multiples of oversampling. For example, 256-ple oversampling may be conceived for practical applications.

Figure 24:
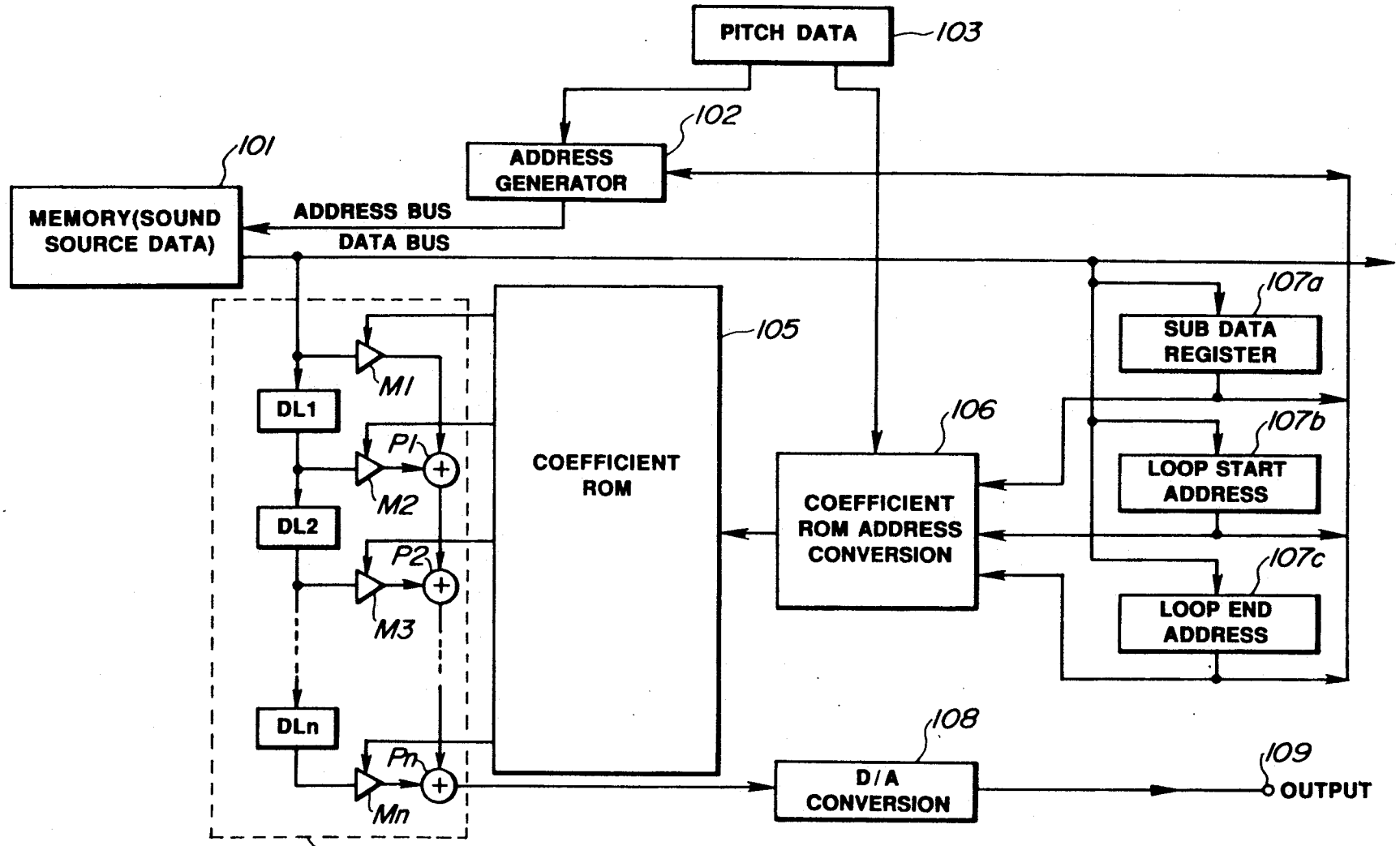
FIG. 24 is a block circuit diagram for illustrating an example of interpolation.

FIG. 24 shows a circuitry for achieving the pitch conversion by the interpolating operation shown in FIG. 23.

In FIG. 24, a memory 101, such as a ROM, in which sound source data are stored, outputs sound source data on the basis of address data stored in an address generator 102. This address generator is supplied with pitch data used in determining the pitch conversion ratio from a pitch data generator 103, while also being supplied with data from a subsidiary data register 107*a*, a loop start address register 107*b* and a loop end address register 107*c*. Based on these data, the aforementioned access data for accessing the memory 101 is generated. The subsidiary data register 107*a*, the loop start address register 107*b* and the loop end address register 107*c* are supplied with respective data from the sound source data. The subsidiary data register 107*a* is used for storing the header data FR shown in FIG. 19, on the block-by-block basis, while the loop start address register 107*b* and the loop end address register 107*c* are used for storing the addresses for the looping start point $LP_S$ and the looping end point $LP_E$. The output data from the subsidiary data register and the loop start and end address register 107*b*, 107*c* are supplied to the address generator 102, while being supplied to a coefficient address converter 106. Pitch data from the pitch data generator 103 are also supplied to the coefficient ROM address converter 106. Based on these output data, the coefficient ROM 105 transmits coefficients previously stored therein to an interpolating filter 104 to determine filter characteristics of the interpolating filter 104. This interpolating filter is formed by, for example, an n number of delay units DL1 to DLn and multiplication units P1 to Pn, and is supplied with sound source data from ROM 101. The sound source data entered into the interpolating filter 104 is converted in pitch at the interpolating filter 104 and converted into analog data at a D/A converter 108 before being outputted as the sound source signal at an output terminal 109.

FIG. 25 shows an example of the loop start address and the loop end address fetched into the registers 107*b*, 107*c*, respectively, wherein it is assumed that a block is formed by plural consecutive samples. When the sample of the loop start point $LP_S$ is necessarily placed at the leading position of the block, only the block number suffices as the loop start address. When looping is started at an optional sample in the block, an in-block sample number becomes necessary as indicated by a broken line in FIG. 25. Not only the in-block sample number but also data indicating the interpolating points between the samples are contained in the loop end address. In this manner, high resolution looping inclusive of the interpolated samples may be achieved by a method similar to that used for the above mentioned pitch conversion. In case of, for example, 256-ple oversampling, the looping domain LP may be set to a resolution of 1/256 of the sampling period $T_S$ so that the resolution of waveform junction may be improved by about 1/256. In addition, with a sound source system making use of an oversampling type pitch conversion system, the present invention may be applied substantially without addition of hardware items with smooth waveform junction and reduction in the looping noise.

The above described method for generating the sound source data in which improvement is achieved as to discontinuities at the repetitive points and the feature that the waveform data of a predetermined period, composed of a plurality of actual samples of a predetermined sampling period Ts, shown by circles in FIG. 21, are interpolated to produce a plurality of interpolated samples, shown by X in FIG. 21, sample on the interpolated sample having 0 wave height value closest to the wave height value is adopted as the connection ample of the repetitive waveform. In FIG. 21, the looping start point $LP_S$ in the looping domain LP corresponding to the repetitive waveform is the actual sample, whereas the looping end point $LP_E$ having a wave height value closest to the wave height value of the looping end point $LP_E$ is the interpolated sample. This is because the wave height value of the above interpolated sample is closer to the wave height value of the starting point $LP_S$ than the wave height value of the actual sample of the looping end point $LP_E'$ of the looping domain LP' formed only by the actual samples according to the prior art practice.

Figure 22:
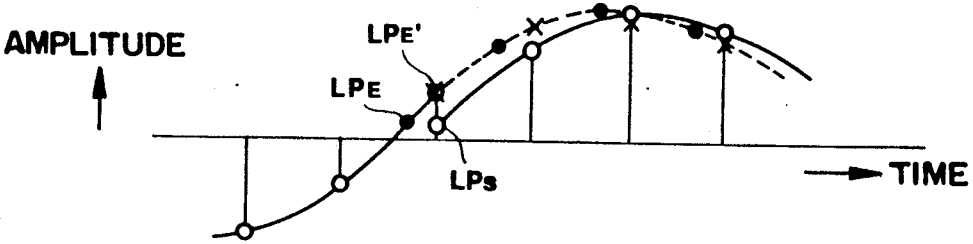
FIG. 22 is a waveform diagram for illustrating the state of waveform connection.

For interconnecting the start point $LP_S$ and the end point $LP_E$, interpolated samples indicated by X are found by interpolation as shown in FIG. 22 so that the sampling indicated by the broken line in FIG. 22 so that the sampling period is not disturbed upon returning from the looping end point to the looping start point.

In the above described method for producing the waveform data, not only the actual samples of the waveform data but also the interpolated samples obtained upon interpolating the actual samples are used as the connecting points, that is the looping start point and the looping end point, of the repetitive waveform data, with the result that waveform continuity at the waveform connecting points is improved as indicated by the broken line in FIG. 22.

Meanwhile, the above mentioned processing, such as the pitch conversion, sampling rate conversion or oversampling, may be classified under linear conversion of first order signals, In such linear conversion, the conventional practice is to fill the gap of discrete data by using the interpolating filters or FIR filters. A number of the interpolating filters equal to the number of the interpolating points between the samples is required. That is, 256 suits of filters are necessary to effect 256-ple oversampling. The filter set formed by 256 filter suits must be matched sufficiently in filter characteristics. Unmatched amplitude characteristics between the filters of the filter set present themselves as the pitch conversion noise or rejection noise produced for each selected filter. Since this type of the digital noise has peculiar frequency characteristics different from the usual white noise, it sounds harsh to the ear even if the sound level is low. Therefore, in many cases, the performance of the overall system is governed by the characteristics of the pitch noise. Thus, when designing the pitch conversion filter it is imperative to design the pitch conversion filter so that the pitch conversion noise is minimized.

Recently, in audio range fields, pitch conversion such as oversampling or sampling rate conversion is frequently employed. This type of processing belongs to linear transformation of first order signals and may be thought of as the first order version of the affine transform frequently employed in image processing. In the case of first order signals, there is some allowance in the computing time. Thus the gaps of the discrete data are filled rather strictly by an arithmetic operation. Thus it has recently become possible with the progress in hardware to make an interpolation between the samples at a high resolution such as by oversampling at a rate of 256 times the sampling rate of the sound source unit.

However, the user has come to have more fastidious taste for sound than for image and does not tolerate incomplete sound making. Although it is possible with the sound source unit to make an interpolation between the samples with the high resolution, it is difficult, due to cost constraints, to provide a number of taps sufficient to achieve 256-ple oversampling.

Under this situation, the hitherto overlooked pitch conversion noise or rejection noise has been presented as a problem. However, under the present status of the art, there has not been evolved a practically useful method for designing a pitch conversion filter will superior properties with the given number of taps, when compared with a FIR filter. Since the know-how concerning the designing of the pitch conversion filter was not available at the earlier stage, no one has succeeded in designing a filter with reduced pitch conversion noise.

The present inventors have tentatively designed various filters free of digital noises despite the use of interpolating filters for pitch conversion of sound source data, and found out as a result of evaluating these filters a point which governs the characteristics of the interpolating filters for pitch conversion.

Thus we have arrived after trial and error that matching of the characteristics of the filters in the filter set is more important than the characteristics of the individual filters, and that, secondly, matching the filter characteristics affects the characteristics of the cut-off region of the FIR low pass filter, in other words, lesser ripples of the cut-off region is more desirable in producing the filter set with favorable characteristics.

In view of the foregoing, there is proposed an interpolating filter comprising an m number of n'th order filters for finding digital data at an m number of interpolating points present in a sampling period for a sampling frequency fs, for producing interpolated data from input digital data of a sampling frequency fs at a resolution of an m-ple sampling frequency m.fs, wherein the m number of the n'th order filters are of similar amplitude characteristics.

The interpolating filters are of consistent amplitude characteristics, while being variable only of phase characteristics, so that no noise is produced during filter switching.

Figure 26:
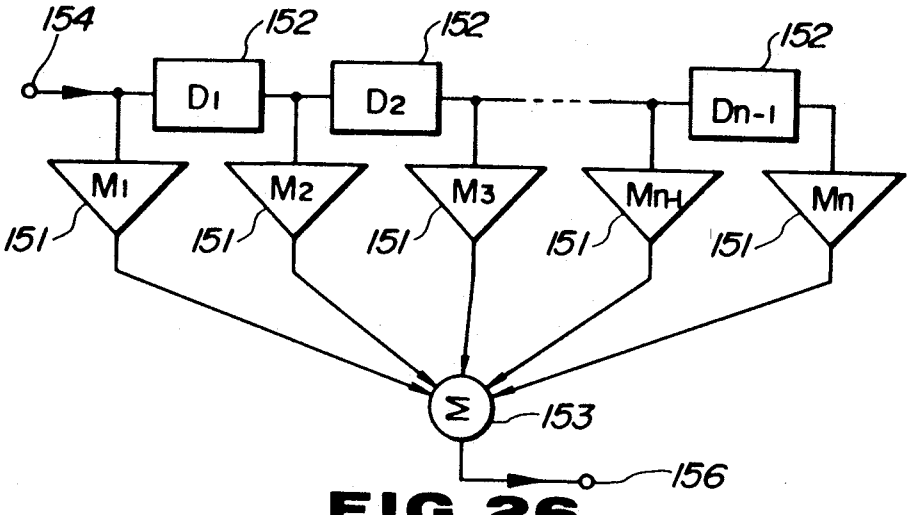
FIG. 26 is a block circuit diagram for showing a basic construction of the interpolating filter.

The typical base construction of the interpolating filter having the aforementioned features is explained by referring to FIG. 26.

FIG. 26 shows an n-th order filter constituted by an n number of coefficient multipliers 151, a (n−1) number of delay units 152 and a sum of products unit 153. Input digital data having a sampling frequency fs is supplied to an input terminal 154 delayed sample-wise by the (n−1) number of the delay units 152 and multiplied sample-wise by the multiplier 151 with coefficients. The output signals are summed together at the sum of products unit 153 before being outputted at an output terminal 156.

For generating interpolated data from the aforementioned input digital data at a resolution of the m-ple sampling frequency m.fs, digital data at the m number of interpolating samples present in the sampling period of the sampling frequency fs are found. That is, the m number of n'th order interpolating filters are provided so as to be of the same amplitude characteristics, whereby digital data generated by the n'th order filters prove to be interpolated data free of digital noises. The m number of the n'th order filters are equivalent to the m number of suits of or sets of coefficients, each suit of coefficients including the m number of coefficients.

The principle of designing the interpolating filters for pitch transformation is hereinafter explained.

By the pitch transformation herein is meant a linear transformation of the waveform on the time axis, that is, $$y(t)=x(at1-b) \tag{15}$$

where x(t) denotes the original signal and y(t) the pitch-transformed signal. The above formula (15) may be thought of as a first order version of the affine transform. If x(t) and y(t) are continuous quantities, transformation from x to y may be made easily from this formula. However, in practice it cannot be made easily because x(t) represents sampled discrete quantities, that is, because x(t) necessary for computing y(t) is not necessarily on the sampling points. In such case, it is necessary to suitably compute interpolated values from several neighboring sampling points.

Hence, in pitch conversion, the samples are interpolated at several points therebetween. By 8-ple oversampling is meant interpolating two samples at eight points therebetween. With the above sound source unit, 256 stage interpolation is performed with a view to assuring sufficient pitch definition. The state of interpolation are herein referred to as resolution R. Thus, with the above sound source unit, R=256. In other words, the interpolated data produced with this resolution R are produced from the input digital data having the sampling frequency fs at a sampling frequency which is m times the sampling frequency fs, or m·fs.

These interpolated values may be computed by providing an n'th order FIR or non-cyclic filter at each of the m number of interpolating points. Thus, an m number of suits of n'th order FIR filters fi(t) are provided, where i=0, 1, 2, . . . , m−1 and t a variable that may be changed by a number equal to the number of the orders. When finding the k'th interpolating points, the convolution with the source input x(t)

$$\sum_{\tau} f_k(\tau)\cdot x(t-\tau) \tag{16}$$

in computed, using the k'th FIR filter fk(t) among the aforementioned m number of suits of the n'th order FIR filters, to find the value of the interpolating points x(t+k/m).

A filter set is formed by the m number of suits of the n'th order FIR filter fi(t) as a whole. Designing the interpolation filter for pitch conversion in tantamount to designing the filter set. The necessary condition for the filter set to operate as the pitch conversion filter is now derived.

For simplifying the explanation, the sampling interval (ts=1/fs) is assumed to be equal to unity. In order for the k'th FIR filter fk(t) to operate as the interpolation filters, the response of this k'th FIR ft(t) must satisfy the formula 17)

$$y(t + (k/m)) = \sum_{\tau} f_k(\tau) \cdot x(t - \tau) \quad (17)$$

by taking Fourier transform of both sides of this formula, $$Y(\omega)exp(j\omega k/m) = F_k(\omega) \cdot X(\omega) \quad (18)$$

is obtained. For demarcation rom the index i, the pure imaginary number $(-1)^{\frac{1}{2}}$ is set as j. From this $$Y(\omega) = F_k(\omega)exp(-j\omega k/m) \cdot X(\omega) \quad (19)$$

Since the formula (19) must hold for each of the n'th order FIR filters, setting $$F_0(\omega) = F_k(\omega)exp(-j\omega k/m) \quad (20)$$

the following formula (21)

$$F_k(\omega) = F_0(\omega)exp(j\omega k/m) \quad (21)$$

is obtained. This formula (21) is the basic formula for an arbitrary k'th filter of the filter set. As long as the n'th order FIR filters of the filter set in their entirety satisfy the formula (21), no pitch conversion noise can be produced. The characteristics of the filter set itself, such as ripple and cut-off characteristics, depend on the characteristics of $F_0(t)$.

The above formula (21) is rewritten to a formula in the time domain. It should be noticed that the k'th FIR filter fk(t) in effect represents a discrete quantity. If the coefficient of the q'th tap of the k'th one of the n'th order FIR filters fk(+) is expressed as fk(q), we may write $$f_k(t) = \sum_{q} f_k(q)\delta(t - q) \quad (22)$$

By developing the Fourier transform, we obtain $$F_k(\omega) = \sum_{q} f_k(q)\exp(-jq\omega) \quad (23)$$

where it is noted that aliasing or folding is not taken into account, Substituting this formula (23) into the formula (21), we obtain $$\sum_{q} f_k(q)\exp(-j\omega(q - (k/m)) = \sum_{q} f_0(q)\exp(-j\omega q) \quad (24)$$

The coefficient of the taps of all of the FIR filters of the filter set may be obtained by solving this equation.

Although the filter set may be obtained by solving the above equation (24), it is very difficult to solve this equation. Thus, in designing an actual filter set, it is produced from a single prototype lowpass filter. Thus we consider and n×m)th order FIR lowpass filter g(t) having the cut-off frequency not more than 1/m of the sampling frequency, that is, not more than fs/m, such as is shown in FIG. 27.

Figure 27:
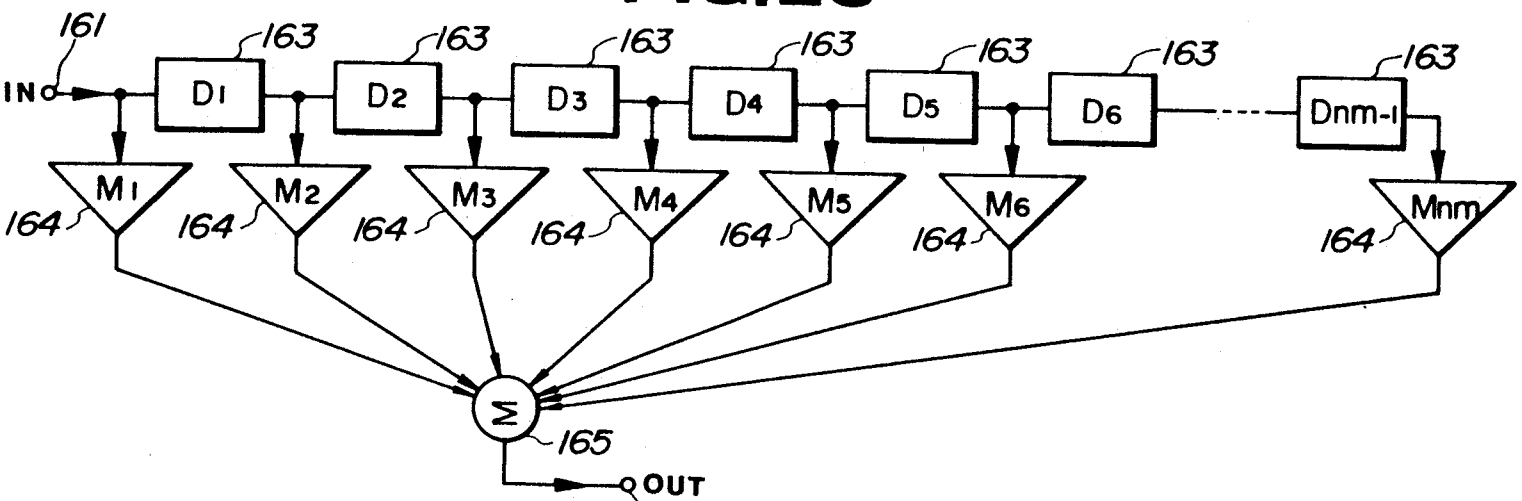
FIG. 27 is a block circuit diagram showing an example of a low pass filter designed for finding the coefficients of the interpolating filter.

The filter of FIG. 27 is made up of a (m×n−1) number of delay units 163, a (m×n) number of multipliers 164 and a summing amplifier 165. An input digital data with the sampling frequency fs is supplied to an input terminal 161 and, after delayed sample-wise by the delay unit 163, is multiplied sample-wise by coefficients by the multipliers 164. The outputs of the multipliers 164 are summed by the summing amplifier. Thus the m number of suits of coefficients of the n'th order filters shown in FIG. 26 may be obtained with the filter of FIG. 27.

It is also possible with the filter of FIG. 27 to produce the aforementioned m number of suits of the n'th order filters by taking out the m number of filters having the same coefficient and constituting the n'th order of filters from these m number of filters.

With the m number of suits of n'th order filters fh(t) produced by taking out every m'th coefficient from the above FIR low pass filter g(t), h being 0, 1, . . . , (m−1), an n number of suits of n'th order filters.

With the m number of suits of n'th order filter fh(t) produced by taking out every m'th coefficient from the above FIR low pass filter g(t), h being 0, 1, . . . , m−1), an m number of suits of n'th order filters $$f_n(t) = g(mt + h) \quad (25)$$

is produced. The filter set of these m number of suits of n'th order FIR filters fh(t) inherently satisfies the aforementioned conditions for the pitch conversion filters.

$$(1/m)G(\omega/m) \quad (26)$$

The pitch conversion filter may be designed rather easily with the use of the formula (26). However, sufficient characteristics occasionaly cannot be obtained on testing with a practically designed filter. Such failure in the filter operation may be attributable to the difficulties in designing the FIR low pass filter with a finite number of taps. Such failure becomes most acute with a higher resolution R of the FIR filter.

The frequency characteristics of the filter set produced from the FIR low pass filter g(t) may be expressed as $$F_h(\omega) = (1/m)G(\omega/m)exp(j\omega h/m) \quad (27)$$

It may be seen from this that the characteristics of $F_0(\omega)$ are those of $G(\omega)$ expanded by m times along the frequency axis. For this reason, in order for the cut-off frequency of the FIR low pass filter which has undergone Fourier transform to be not more than one half the sampling frequency, that is, not more than fs/2, the cut-off frequency of the FIR low pass filter $G(\omega)$ which has undergone Fourier transform must be not more than ½m times the sampling frequency, that is, not more than fs/2m.

On the other hand, the frequency components of the FIR low pass filter $G(\omega)$ having the cut-off frequency not less than ½m times the sampling frequency, that is, not less than fs/2m, unexceptionally appear as aliasing on $F_0(\omega)$. These aliasing components have different phase components from filter to filter. The difference caused in this manner may translate itself as the difference in filter characteristics to produce the pitch conversion noise.

Thus it may be seen that the higher the resolution R of the filter set, the lower becomes the cut-off frequency demanded of the aforementioned FIR low pass filter. With an insufficient number of orders n of the filter, fully satisfactory filter characteristics cannot be obtained unless the filter is designed most ingenuously since it is generally difficult to produce filters with an extremely low or extremely high cut-off frequency.

Although the effect of aliasing has not been considered in the above mentioned filter designing, the aliasing components of up to the first order are considered in the following explanation. Since the frequency characteristics of the FIR filter fh(t) is generally an even function assuming a real number, the frequency characteristics of the FIR filter F(ω) is also an even function assuming a real number.

Considering only the portion $0<\omega$ for simplication, the frequency characteristics of the aforementioned FIR filter fh(t), containing up to the first order aliasing, may be expressed as $$F_h(\omega)=F_h(\omega)+F_h(\omega+2\pi) \quad (28)$$

Substituting the equation (27) into the equation (28), $$F_h(\omega)=\exp(j\omega h/m)(F_0(\omega)-R(\omega)exp(2\pi jh/m)) \quad (29)$$

where R(ω) is set so that $$R(\omega)=(1/m)G((\omega+2\pi)/m \quad (30)$$

The term R(ω) exp(2πjh/m) in equation (29) represents an error component, which is not other than the frequency characteristics of the FIR low pass filter. This term is responsible for noise since it causes the filter characteristics to be changed from filter to filter. Considering that the FIR filter F(ω) and R(ω) represent real numbers, the maximum value of this error becomes $$\Delta F=\max(A)-\min(A)=2\,||\,R(\omega)\,|| \quad (31)$$

where $A=F_0(\omega)+R(\omega)exp(2\pi jk/m)$. That is, the maximum value of the error is twice the norm of R(ω).

It is seen from above that, with $$\Delta F=2\,||\,R(\omega)\,||<2^{-Nb} \quad (32)$$

where Nb represents the bit length of the filter coefficient, the pitch conversion noise may be within the range of the quantization noise. Since Nb=12 in the above sound source unit, it is necessary that the gain of the cut-off range be such that $$||\,R(\omega)\,||<(2^{-Nb}/2)=-78[dB] \quad (33)$$

On the other hand, the maximum shift in filter characteristics occurs between two filter suits spaced apart by m/2 from each other, since the phase of R(ω) is reversed at this time. In pitch conversion, this may occur when the pitch is raised by five points or lowered by one octave, so that the above filter suits are most likely to be selected alternately.

These conditions for the inhibit region are rather severe as compared with the designing of an ordinary filter. With the designing of an ordinary filter, it is not attempted to suppress the ripples of the inhibit region to this extent, but it is simultaneously attempted to improve cut-off characteristics. However, if the S/N ratio corresponding to the bit length of the filter coefficient of the pitch conversion filter is to be procured, the above mentioned conditions must be satisfied at the costs of any other conditions.

The following is the summary of the above described designing technique for the pitch conversion filter.

With the pitch conversion filter fh(t) having the resolution R and the number of orders n, each filter of the filter unit must satisfy the characteristics $$F_h\omega)=F_0(\omega)exp(j\omega h/m) \quad (34)$$

The filter unit may be produced by taking every m'th coefficient from the (n×m)th order low pass filter and sequentially arraying the taken-out coefficients.

For coincidence of the filter set characteristics and suppression of the pitch conversion noise, it suffices to suppress the gain of the inhibit region of the prototype low pas filter so that $$||\,R(\omega)\,||<(2^{-Nb}/2) \quad (35)$$

When applied to the sound source unit shown in FIG. 1, the interpolation filter based on the above described designing method is employed for the pitch converter 131.

Thus, as described hereinabove, the converter 131 converts the pitch or sound height of the analog signal, at the time when it is converted from the signal Sd, into the pitch corresponding to the operated key on the keyboard, by 256-ple oversampling of the signal Sd, followed by re-sampling, and thus without changing the sampling frequency of the signal Sd.

The aforementioned interpolation filter includes a thinning-out filter which ultimately thins out sampling data.

With the above described interpolation filter, the same amplitude characteristics of the filters of the interpolation filter set coincide with one another so that the noise otherwise produced at the time of filter switching may be eliminated. Thus the sampling sound with an extremely high S/N ratio may be reproduced.

Meanwhile, for improving the continuity between the looping start point and the looping end point of the looping domain, in the above described embodiment, the parameters for the looping start point are formed on the basis of the data for the looping start and the looping end point. Alternatively, the straight PCM data may be used for several blocks of the looping start block.

In general, the sound source data compression and encoding method comprises forming compressed data words and parameters relating to compression, from digital data corresponding to an analog waveform portion of a predetermined number of periods, with the blocks each including a predetermined number of samples as units, forming one or more compression code blocks each including a predetermined number of the compressed data words and the parameters therefor and storing the compression code blocks in a storage medium, wherein the improvement resides in that straight PCM words are stored in a predetermined number of incipient words of at least the first one of the compression coding block or blocks.

Figure 28:
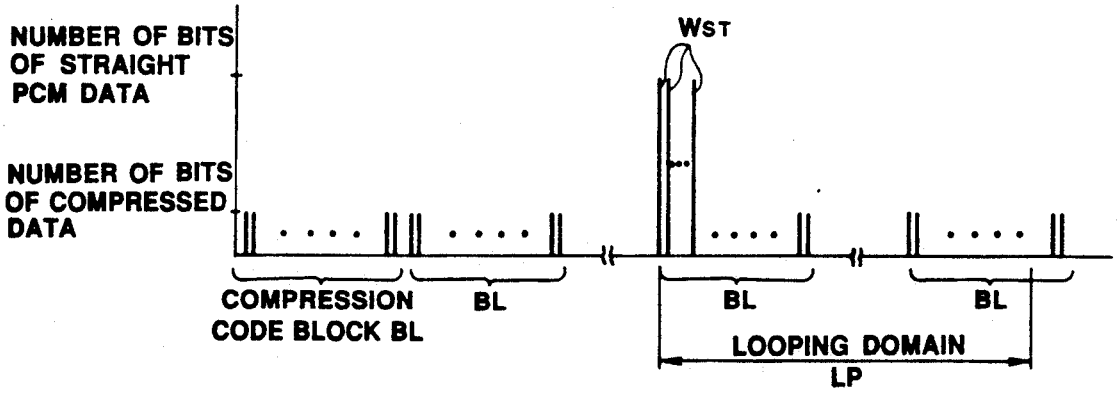
FIG. 28 is a view for illustrating the operation of arraying straight PCM data at the starting portion of the looping domain.

Referring now to FIG. 28, the looping domain LP corresponds to a predetermined number of periods of the analog waveform, and the predetermined number of the incipient words of the first compression coding block BL in the looping domain LP are straight PCM words $W_{ST}$. The number of the straight PCM words may be not less than the number of the orders at the time of compression encoding.

Meanwhile, at least the first block means that the blocks in their entirety are processed in the above sense.

With the sound source data compressing and encoding system, the predetermined number of incipient words of at least the first block of one or more blocks obtained upon compression encoding of waveform data of a predetermined number of periods corresponding to a looping domain are straight PCM words. In this manner, when interconnected the looping points during looping, the straight PCM words may be used directly as the looping start point data so that there is no necessity for making predictions from the data in the vicinity of the looping end point and hence the effects by the past data may be eliminated.

The above is the description on the construction and operation of the generation and the recording, that is the storage on the memory, of the sound source data. The construction and operation of the reproducing side, that is the side of reading out and decoding, e.g. looping, sound source data from the memory to produce output musical sound signals, is hereinafter explained. The reproducing side device may be used alone as the sound source device.

Figure 29:
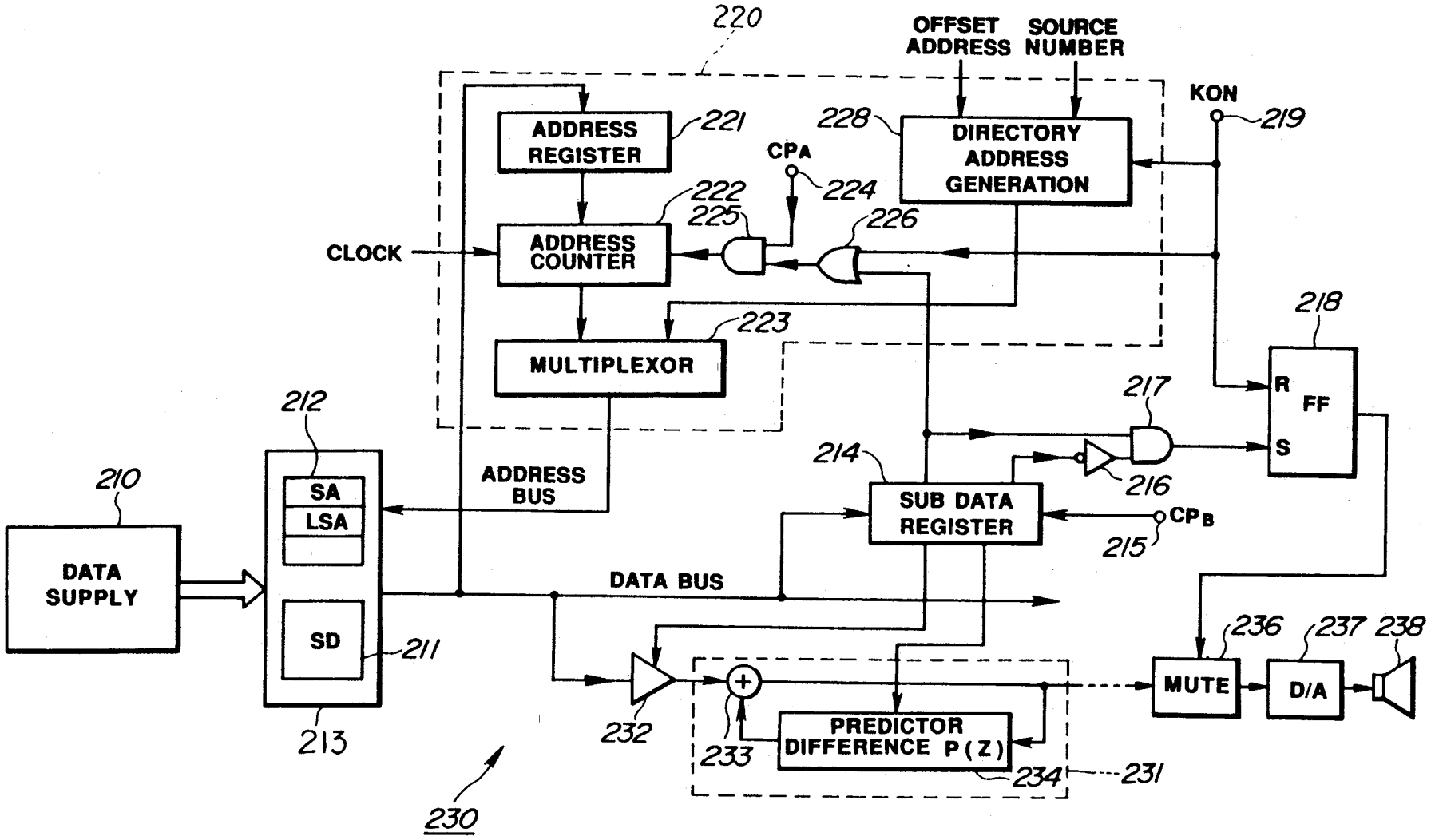
FIG. 29 is a block diagram showing an example of the sound source reproducing side.

FIG. 29 is a block circuit diagram showing a practical example of the sound source data reproducing device or sound source device for reading out sound source data produced during the above process and stored in a sound source data memory 211 and performing decoding at the decoder 90 of FIG. 18 or the aforementioned looping.

In FIG. 29, sound source data are supplied from a sound source data supplying means 210 to a memory 213 including the memory 211 and an address data memory 212. The sound source data supply means 210 may be the aforementioned sound source data generating and/or recording device per se, or a device for reproducing the recording medium, such as an optical disk, magnetic disk or magnetic tape.

The shifter 92, the summing point 93 and the predictor 94 in the decoder 90 of FIG. 18 correspond to a shifter 232, a summing point 233 and a predictor 234 of FIG. 29. Thus the circuit of FIG. 29 mainly performs the decoding operation at the decoder 90 of FIG. 18. The decoded sound source data are processed by envelope addition, reverberation or echoing and transmitted via a muting circuit 236 to a D/A converter 237 so as to be reproduced from a loudspeaker 238 as the analog musical sound signal.

The circuit of FIG. 29 has an address generator 220 responsive to key-on to effect reading of the sound source data stored in the memory 213 and reading for looping. This address generator 220 has an address register 221 to fetch data start address data SA from the address data memory 212, an address counter 222 loaded with the address data and responsive to clocks to effect counting and a multiplexor 223 supplied with the address output from the address counter 222. The load control terminal or present control terminal of the address counter 222 is supplied with a timing pulse CPA from terminal 224 via AND gate 225, which is controlled by an output from an OR gate 226. A directory address generator 228 is provided in the address generator 220 and the address output from the directory address generator 228 is transmitted to the multiplexor 223. One of the directory address output or the address output from the address counter 222 in selected by the multiplexor 223 and the memory 213 is accessed by the address output from the multiplexor 223.

A subsidiary data register 214 fetches the header data, that is the parameter data concerning the compression or sub-data, at the timing at which the timing pulse $CP_B$ as later described is supplied to a terminal 215. The looping data L1, that is the data indicating the presence or absence of looping among the sub-data fetched by the register 214, is transmitted via inverter or NOT gate 216 to an AND gate 217, while the end data EI, that is the data indicating whether or not the block is the waveform end block, is supplied to an AND gate 217 and to the OR gate 226. The output signal from the AND gate 217 is supplied to a set terminal S of a flipflop 218, to a reset terminal R of which the sound generation start signal or the key-on signal KON from terminal 219 is supplied. This key-on signal KON is also supplied to the OR gate 226 and to the directory address generator 228. This key-on signal KON includes not only a key-on data for the electronic musical instrument but also the sound generation start trigger signal for starting the software for automatic musical performance.

Figure 30:
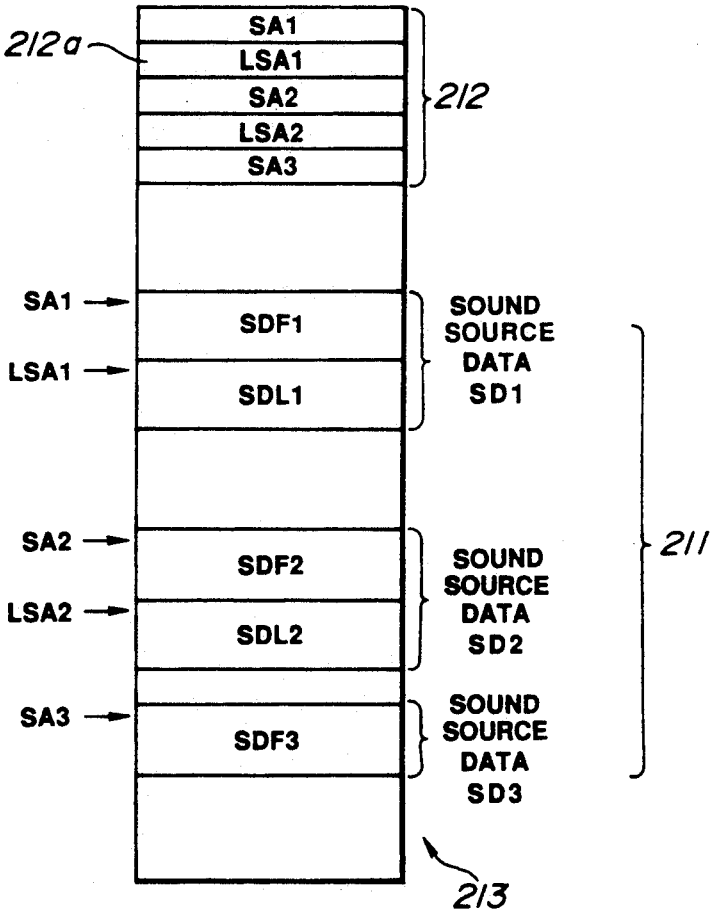
FIG. 30 is a view showing an example of memory contents.

FIG. 30 shows an example of the contents of the memory 213 which is a 64K byte RAM, for example, divided into a portion of the sound source data memory 211 and a portion of the address data memory 212. This address data memory 212 is a portion of the so-called directory region in the memory in which the aforementioned data start address data SA and the looping start address data LSA are accessed by the directory address from the directory address generator 228. The leading address portion SDF which is composed of a first plurality of consecutive samples and which corresponds to the formant portion FR of the signal waveform, and the leading address of a data portion SDL, which is composed of a second plurality of consecutive samples and which corresponds to the looping domain LP, are indicated by these data SA and LSA. Although the example of FIG. 30 shows sound source data SD1 composed of formant data SDF1 and looping data SDL2 indicated by data SA1 and LSA1, respectively, sound source data SD2 composed of data SDF2 and SDL2, indicated by data SA2 and LSA2, respectively and data SDF2 indicated by data SA3, sound source data composed only of the looping portions may also be employed. In practice, the address data SA and LSA indicate only the addresses of the header data for sub-data RF of FIG. 19, with the compression encoding blocks as units, and more detailed address indication, such as address indication or the byte-by-byte basis, is performed by the aforementioned address counter 222.

Figure 31:
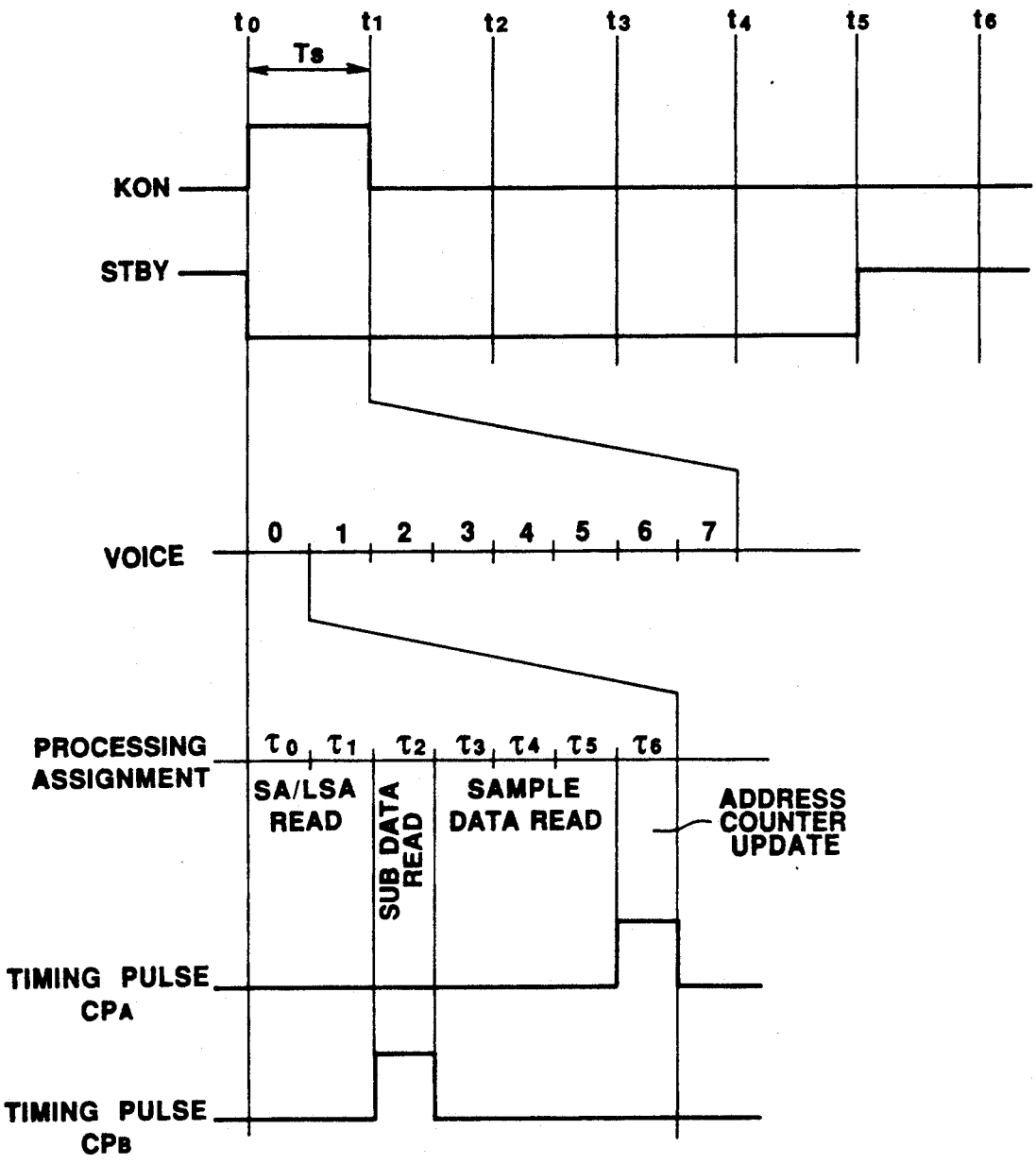
FIG. 31 is a timing chart for illustrating the main operation of the circuit of FIG. 29.

The device as shown and described in the foregoing operates as follows:

FIG. 31 is a timing chart for illustrating the time sharing signal processing in which $T_S$ stands for the timing period. When the sampling frequency is 32 kHz, the sampling period $T_S$ is equal to 1/32 ms. Each sampling period $T_S$ is divided into a number of voices that can be produced simultaneously, herein eight (voices 0 to 7) and the time allocated to each voice is subdivided as a function of the contents of the time starting processing. With the minimum unit time $\tau$ of this time sharing processing, the time intervals $\tau_0$ and $\tau_1$ are allocated for fetching the address data SA or LSA of the directory region, the time duration $\tau_2$ to $\tau_5$ is allocated for fetching the bit compression encoding data and the time interval $\tau_6$ is allocated for updating the address counter 222. The time interval $\tau_2$ of the time duration $\tau_2$ to $\tau_5$ is allocated to fetching the sub-data (header data RF of FIG. 19) while the time interval $\tau_3$ to $\tau_5$ is allocated to fetching the sample data (data $D_{A0}$ to $D_{B3}$ of FIG. 19). The timing pulse $CP_A$ is outputted at the timing of the time interval $\tau_5$ while the timing pulse $CP_B$ is outputted at the timing of the time interval $\tau_2$.

The key-on signal KON for starting the sound generation is outputted during one sampling period $T_S$, that is, goes high during the interval $t_0$ to $t_1$ in the illustrated example. A stand-by signal STBY falls at the leading edge of the KON signal and rises after several sampling periods or at time $t_5$ after five sampling periods.

When the key-on signal KON is entered into terminal 219, the directory address generator 228 generates a directory address, on the basis of the offset address of the memory as set by the CPU system and the source number indicating the kind of the sound source, and transmits the directory address to the multiplexor 223. During the time division slot time intervals $\tau_0$ and $\tau_1$, the multiplexor 223 selects the address output from the directory address generator 228 to access the memory 213 to read out predetermined address data in the address data memory 212, that is the data SA indicating the sound source data start address corresponding to the source number to fetch the data SA into the address register 221 over data bus. At this time, the key-on signal KON is transmitted via OR gate 226 to the AND gate 225 to turn on the AND gate 225, so that the pulse $CP_A$ of the timing of the time slot $\tau_0$ is entered into a load control terminal of the address counter 222 and the data start address data SA fetched into the address register 221 is loaded or preset into the address counter 222. The address counter 222 starts counting from this data SA on so that the sound source data SDF in which the data SA proves to be the leading address are accessed in the order indicated by the address. When there exists loop data SDL consecutive to the data SDF, the loop data SDL is automatically sequentially accessed next to the data SDF.

After the sampling period following the sampling period during which the key-on signal KON is outputted, that is, after time $t_1$, the key-on signal KON reverts to its initial state, that is the low-level state, the directory address generator 228 outputting the start address data LSA of the loop data SDL. Thus the address generator 228 fetches this loop start address data LSA. However, unless an input signal is applied to the load control terminal, the address counter 222 is not loaded with an address from the address register 221 but continues its counting operation. This operation does not apply when the input data is formed only by the data SDF of the formant portion.

When the flag of the end data EI from the sub data register 214 is set, that is when the end block of the loop data SDL or when the end block of the data SDF of the formant portion is reached, the AND gate 225 is turned on via the OR gate 226 so that the looping start address data LSA in the address register 221 is loaded or preset into the address counter 222 at the input timing of the timing pulse $CP_A$. However, as mentioned hereinabove, the address data SA or LSA is the address with the bit compression block as a unit and, as the actual operation, the looping start block of the sound source data is accessed at the timing of the signal processing of the next block.

The above end data EI is also transmitted to the AND gate 217. The NOT output of the data LI concerning the presence or absence of looping is transmitted to this AND gate 217, so that, when the sound source data consists only of the first kind of data SDF3 (data corresponding to the formant portion) and devoid of the looping domain data SDL, the output form the NOT gate 216 goes high. When the end block of the sound source data SD3 is reached, the output from the AND gate 217 goes high to set the flipflop 218 to control the muting circuit to a muted state, that is, a state of cutting of audio signals. The above is the muting operation when there is no looping. When there is a looping, looping reproduction is repeated until the next key-on is made and sound muting is achieved by envelope processing. When the key-on signal KON is entered, this signal is entered to a rest input terminal R of the flipflop 218, which is reset without regard to the preceding state, so that the above muting state is cancelled.

Meanwhile, using the two sound source data SD1, SD2 of FIG. 30 and, above all, the looping data portions SDL1, SDL2 thereof, sound source data from the exterior sound source supply means 10 many be alternately fetched into and read out from the memory area for SDL1 and SDL2 so as to be decoded at a decoder 230 to perform decoding of the sound source data for a prolonged time. That is, while sound source data from the one memory area for SDL1, SDL2 is read out and decoded, sound source data from the exterior sound source data supply means 210 are written into the other memory area, such that data writing and reading are performed alternately into and out of these memory areas.

This may be realized very easily by alternately changing the looping start address data LSA1 to the looping start address data LSA2 and vice versa for the looping operation. That is, in the memory 213 shown in FIG. 30, address data written in the memory area 212*a* is changed from the looping start address data LSA1 to the looping start address data LSA2. Thus, during the time when the sound source data SDL1 is read and decoded, the looping start address data LSA2 is written into the memory area 212 so as to be fetched into the address register 221. When the end of the data SDL1, that is, the looping end point, is reached, the sound source data SDL2 starts to be accessed from the start address LSA2 by loading the address data LSA2 into the address counter 222. Then, during the time this sound source data SDL2 is read out and decoded, the looping start address data LSA1 is written into the memory area 212. When the end of the data SDL2, that is the looping end point is reached, this address data LSA1 is loaded into the address counter 222 so that the sound source data SDL1 starts to be accessed. In this manner, continuous decoding of the sound source data may be realized for prolonged time without increasing the hardware.

Figure 32:
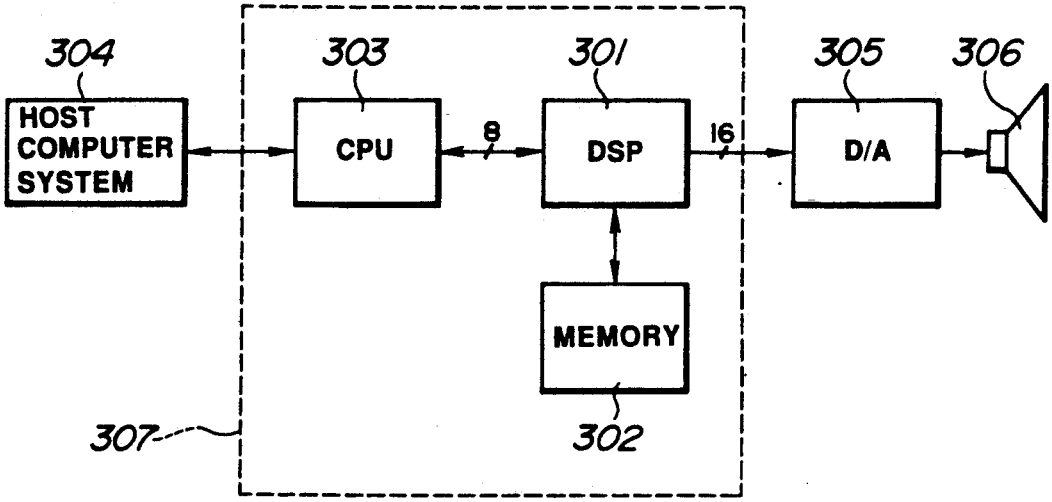
FIG. 32 is a block diagram showing the construction of an audio processing unit with its peripheral device.

In is noted that digital signal processing for the above mentioned bit compression encoding or other digital signal processing for sound source generation is frequently performed by a soft ware technique using a digital signal processing (DSP), and reproduction of the recorded sound source data is also frequently performed by a software technique using the SDP. FIG. 32 shows as an example an overall system comprised of an audio processing unit or APU 307 as a sound source unit handling sound source data with its peripheral circuits.

In this figure, a host computer 304, provided in a customary personal computer, a digital electronic musical instrument or a TV game set, is connected to an APU 307 as the sound source unit, so that sound source data are loaded from the host computer 304 into the APU 307. Thus the above mentioned sound source data supply means 210 is provided in the host computer 304.

The APU 307 is at least mainly composed of a central processing unit or CPU 303, such as a micro-processor, a digital signal processor or DSP 301 and a memory 302 storing the sound source data. Thus, at least the sound source data are stored in the memory 302, and a variety of processing operations, inclusive of read-out control, of the sound source data, such as looping, bit expansion or restoration, pitch conversion, envelope addition or echoing (reverberation) are performed by the DSP 301. The memory 302 is also used as the buffer memory for performing these various processing operations. The CPU 303 controls the contents or manner of these processing operations performed by the DSP 301. The CPU 303 also performs such operations as rewriting address data LSA in the above mentioned memory 213 (memory 302) or writing sound source data from the sound source data supply means 210 (within the host computer 304) into the memory 213.

The digital musical sound data, ultimately produced after these various processing operations by the DSP 301 of the sound source data from the memory 302 are converted by a digital-to-analog (D/A) converter 305 (corresponding to the D/A converter 237) before being supplied to a speaker 306.

The following is a generalized elucidation of several characteristic portions or features of the present invention which are extracted from the construction of the above described sound source device or sound source data reproducing apparatus.

Figure 33:
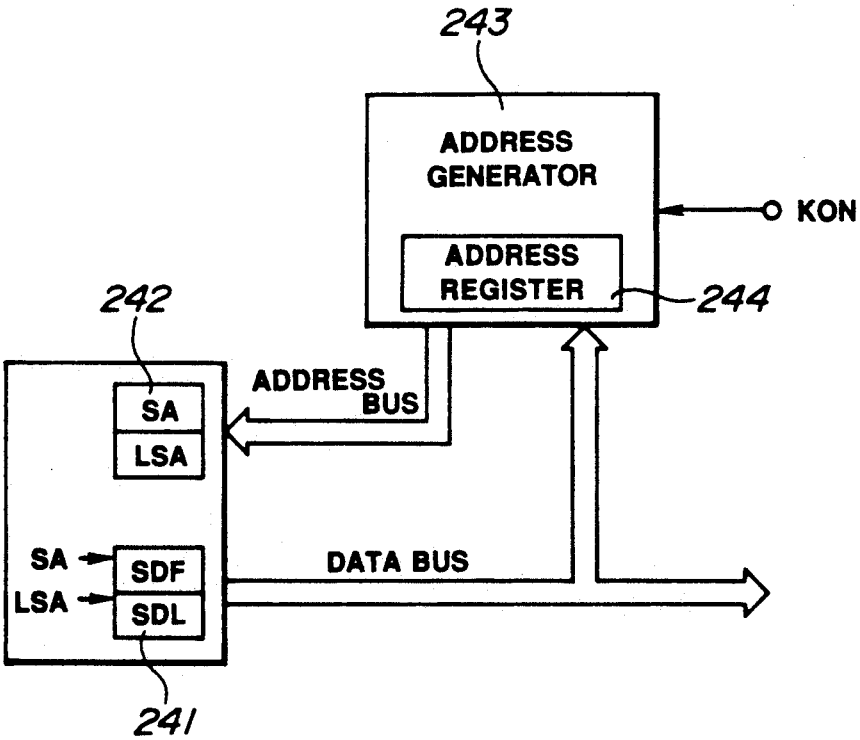
FIG. 33 is a functional block diagram showing the basic construction of the sound source device with a smaller number of times of memory fetches.

First, as a technical notion for reducing the number of times of fetching into a memory when loading data start or looping start addresses into an address register of an audio signal processing apparatus, a generalized sound source device shown schematically in FIG. 33 may be conceived.

The sound source device shown in FIG. 33 includes a sound source data memory 241 (221 in FIG. 29) for storing sound source data consisting of a data portion SDF composed of a first plurality of consecutive samples and a data portion SDL composed of a second plurality of consecutive samples, a start address data memory 242 (212 in FIG. 29) for storing a data start address data SA associated with the sound source data and a looping start address data LSA, and an address generator 243 (220 in FIG. 29) for generating the read-out address for the sound source data memory 241 on the basis of the data start address data SA and the looping start address data LSA. The above mentioned data start address data SA from the start address data memory 242 is loaded into, for example, an address register 244 (221 in FIG. 29) within the address generator 243, the data SDF of the first plurality of consecutive samples are read from the storage region starting from the data start address of the sound source data memory 241, the looping start address data LSA from the start address data memory 242 is loaded into an address register 244 of the address generator 243, and the data SDL of the second plurality of consecutive samples are repeatedly read out to reproduce analog or digital/audio signals.

With the sound source device shown in FIG. 33, the data start address data are loaded in the address generator to read out the first plurality of consecutive samples. The looping start address data are then loaded into the address generator to repeatedly read out the second plurality of consecutive samples. Thus, until next sound source regeneration, the first plurality of consecutive samples are not read out. More specifically, one of the looping start address data or the data start address data of the sound source data is loaded responsive to the key-on signal. In this manner, the data start address data is loaded during key-on and the looping start address data is loaded otherwise, so that the number of times of fetching into the memory may be reduced to realize a more simplified time divisional processing.

Figure 34:
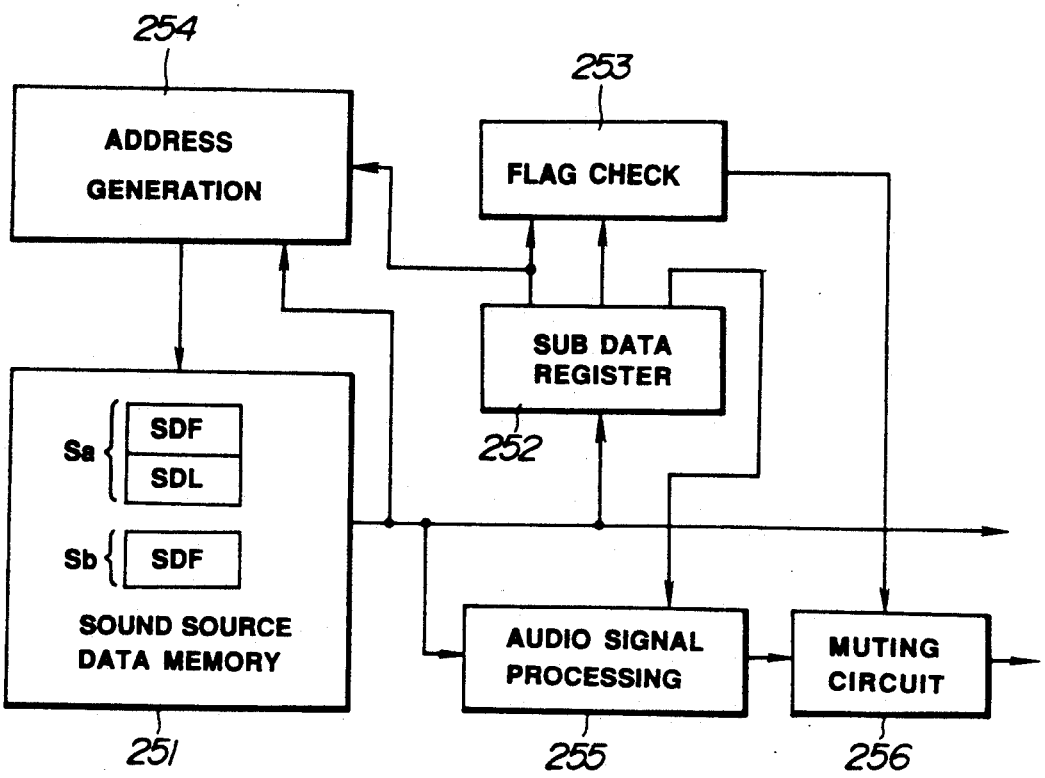
FIG. 34 is a functional block diagram showing the basic construction of the sound source device in which looping and the operation of terminating the reproduction of sound source data devoid of looping.

A sound source device implementing a technical concept of facilitating the processing such as judgment on the presence or absence of the looping domain or termination of reproduction of the sound source data devoid of the looping domain, is shown only schematically in FIG. 34.

The sound source device shown in FIG. 34 includes a sound source data memory 251 (211 in FIG. 29) for selectively storing sound source data consisting of a first kind of plural consecutive samples Sa inclusive of a repeatedly reproduced looping domain and a second kind of plural consecutive samples Sb devoid of the looping domain, a sub data register 252 (214 in FIG. 29) extracting data associated with the sound source data, a flag check circuit 253 (216 to 218 in FIG. 29) for detecting a flag indicating the presence or absence of the looping domain of the sound source data and the ned of the sound source data from the extracted data, an address generator 254 (220 in FIG. 34) for generating the address for reading the first kind of plural consecutive samples Sa and the second kind of plural consecutive samples Sb of the sound source data memory 251, from the sound source data and the data extracted from the sub data register 252, an audio signal processing circuit 255 (such as 230 in FIG. 29) for processing, e.g. decoding, the sound source data on the basis of the extracted data for producing reproducible data, and a muting circuit 256 (236 in FIG. 29) for muting the processed sound source data by the above mentioned flag of the flag check circuit 253. The first or the second kind of plural consecutive samples Sa are repeatedly read from the sound source data memory 251 to reproduce analog or digital/audio signals while muting is applied when the discriminating flag indicates that the sound source data is devoid of the looping domain and also that the sound source data is terminated.

With the sound source device shown in FIG. 34, there is provided the discriminating flag indicating the end of the sound source data associated with the sound source data, and muting is applied on detection of the discriminating flag indicating that there is no looping domain and the sound source data is terminated. Thus, by the discriminating flag indicating the presence or absence of the looping domain, the first kind of plural consecutive samples is repeatedly read from the sound source memory or the second kind of plural consecutive samples is read out to reproduce the analog or digital audio signals, whereas, by the discriminating flag indicating the end of the sound source data, muting is applied, so that looping control may be facilitated without increasing additional data for looping. Similar effects may be realized by using, in addition to the discriminating flag indicating the presence or absence of the looping domain, a flag indicating the end with looping and a flag indicating the end without looping.

Figure 35:
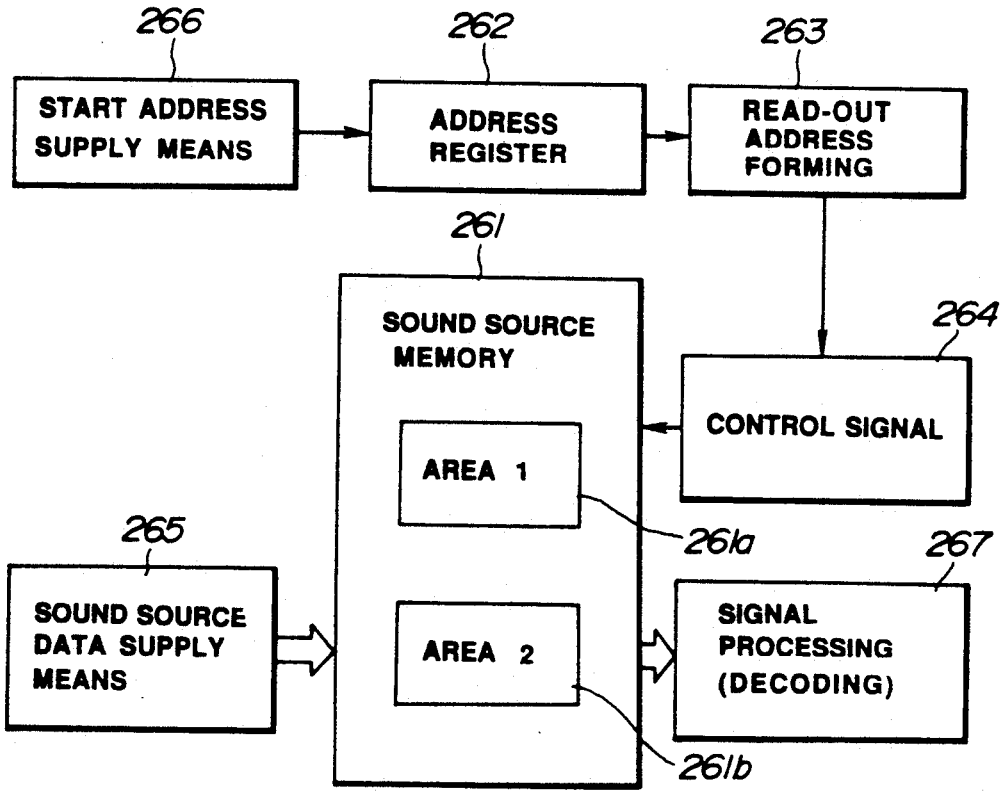
FIG. 35 is a functional block diagram showing the basic construction of the continuous sound source data reproducing apparatus.

FIG. 35 shows the basic construction of the extracted continuous sound source data reproducing function.

The continuous sound source data reproducing device shown in FIG. 35 includes a sound source memory 261 (memory 212 in FIG. 29) having first and second sound source memory areas 261*a*, 261*b*, an address forming circuit 263 for forming a read-out address or the basic of the start address of the address register 262, control means 264 for alternately reading out the sound source data from the first and second sound source areas 261*a*, 261*b* on the basis of the read-out address, sound source data supply means 265 for writing sound source data in one of the first and second sound source areas 261*a*, 261*b* when reading out sound source data in the other sound source area, start address supply means 266 for writing in said address register 262 start address of the first or second sound source memory areas 261*a*, 261*b* into which said sound source data are written, and a signal processing means 267 for processing the sound source data read out from the first and second sound source memory areas 261*a*, 261*b*.

With the sound source device shown in FIG. 35, the read-out address is formed on the basis of the start address of the address register and the sound source data are read out alternately from the first or second source memory areas on the basis of the thus formed read-out address. The sound source data are fetched from one of the first or second sound source memory areas while the sound source data are written into the other sound source memory area. Thus the noise-free reproduction of continuous sound source data and the looping reproduction other than the synchronized waveform or repetitive waveform during reproduction of the continuous sound source data become feasible.

On the other hand, such data reproduction become feasible by suitably swapping the start addresses of the address registers without hardware addition or timing control.

With the construction shown in FIGS. 33 to 35, the three features of the sound source reproducing device or sound source device are extracted and shown schematically.

Meanwhile, when the technology explained with reference to FIG. 28 is employed on the sound source data generating and recording side, that is when the straight PCM data are employed at the predetermined number of leading words of the starting block for the looping domain, the construction shown for example in FIG. 36 may be conceived. While the one block of the bit compression data is substantially similar to that shown in FIG. 19, two 1-bit flag data, such as the data indicating the block inclusive of the loop start point, or loop start flag LSF and data indicating the block inclusive of the loop end point, or loop end flag LEF, are employed in lieu of the looping presence or absence indicating flag and the loop end flag.

Figure 36:
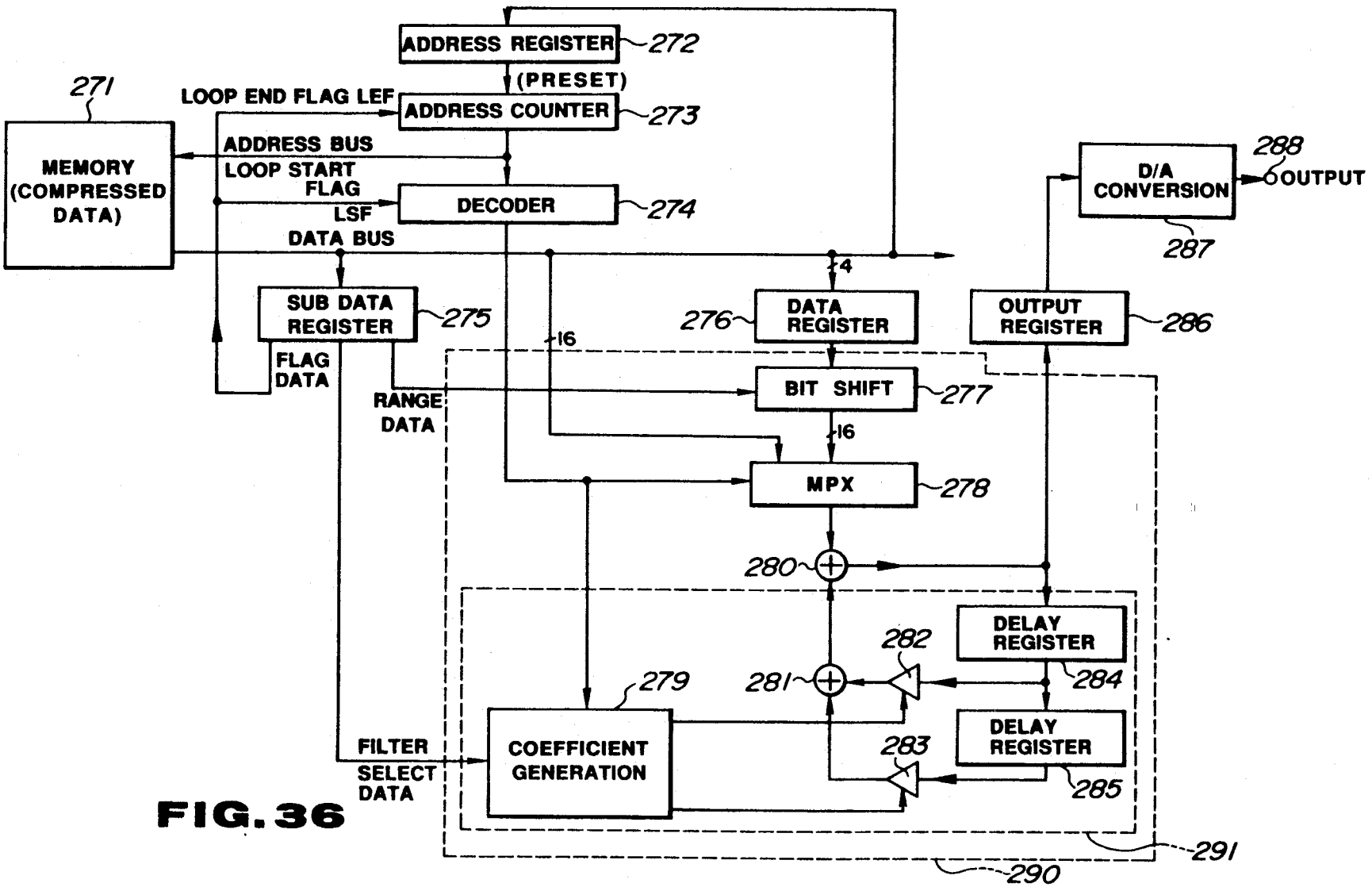
FIG. 36 is a block circuit diagram showing another construction of the sound source data reproducing side.

Referring to FIG. 36, there are stored in the memory 271 the aforementioned compression encoded sample data or parameter data (header data RF and sub data shown in FIG. 19) or sound data. The looping start address (address of the looping start block in the memory) is also stored therein as the directory data. At least the looping start data are transmitted to and stored in the address register 272 over a data bus of the memory 271 so as to be preset in an address counter 273 right before the end of looping. The decoder 274 outputs, responsive to the output from the address counter 273 and the looping start flag LSF, a straight PCM switching control signal during the time of a predetermined number of leading words in the looping start block, that is, during the time when the straight PCM data are issued. When plural kinds of sound source data are stored in the memory 271, the leading addresses of the sound source data and the looping start addresses are stored in the memory 271. Responsive to, for example, key-on, the leading addresses of the sound source data corresponding to the pre-selected sound source are read out from the directory of the memory 271 and present via address register 272 in the address counter 273 to sequentially read out data from the leading address on. If there is only one kind of the sound source data, the address counter 273 only need to respond to key-on to start counting from the predetermined initial value (leading address of the sound source data).

Of the sound source data read out from the memory 271, the aforementioned parameter data, that is the sub-data and header data RF in Fig. 19, are transmitted to a sub-data register 275 so as to be stored transiently therein. The 4-bit compressed data, produced upon compression encoding, that is the sample data $D_{AOH}$ to $D_{B3L}$ of FIG. 19, are transmitted to and transiently stored in a data register 276. Of the sound source data from memory 271, the straight PCM data of the predetermined number of leading words of the looping start block are transmitted to a multiplexor 278.

The compressed data, transiently stored in the data register 276, are transmitted to a bit shift circuit 277, corresponding to the shifter 92 of the decoder 90 of FIG. 18. The output from the bit shift circuit 277 is transmitted via the multiplexor 278 to a summing point 280 corresponding to the summing point 93 shown in FIG. 18. The output from the summing point 280 is transmitted to an output register 286 and to a predictor 291 corresponding to the predictor 94 of FIG. 18, with the output from the predictor 291 being fed back to the summing point 280. The predictor 291 includes two delay registers 284, 285, coefficient multipliers 282, 283 for multiplying the outputs from these delay registers 284, 285 with coefficients and a summing point 281 for summing the outputs from the multipliers 282, 283. The multiplication coefficients of the multipliers 282, 283 are determined by a coefficient generator 279. The predictor 291, the summing point 280 and the bit shift circuit 277 constitute the decode 290 for decoding the bit compression encoding data.

Of the header data FR transiently stored in the sub-data register 275, the range data and the filter selection data are transmitted to the bit shift circuit 277 and to the coefficient generator 279, respectively, while the loop end flag LEF and the loop start flag LSF are transmitted to the preset control terminal of the address counter 273 and to the decoder 274, respectively.

The above mentioned 4-bit compressed data are decoded in the decoder 290 of FIG. 36, as in the decoder of FIG. 18, so as to be transmitted as the 16-bit wave height value data to a D/A converter 287 via output register 286 and taken out as the analog musical sound signal at an output terminal 288.

The operation of returning from the looping end point to the looping start point during looping reproduction is hereinafter explained. When the sound source data of the block including the looping end point is read out, the loop end flag LEF of the sub-data is set. Based on this loop end flag LEF, when the looping end point is reached, the looping start point from the address register 272 is preset in the address counter 273. Thus the address counter 273 starts accessing the looping start block of the memory 271 via address bus to read out the straight PCM data of the predetermined number of leading words. During the time when the straight PCM data are read out, the decoder 274 performs such control in which it outputs and transmits the straight PCM switching control signal to the multiplexor 278 and the coefficient generator 279 to transmit the straight PCM data directly to the output register 286. That is to say, the multiplexor 278 selects and outputs the straight PCM data from the memory 271, while the coefficient generator 279 transmits to the coefficient multipliers 282, 283 multiplication coefficients which will constitute the 0'th order filter, so that the straight PCM data are directly obtained at the output of the summing point 280.

Inasmuch as the straight PCM data may be used directly as the looping start point data, there is no necessity for performing predictions from the looping end point data and hence the errors otherwise produced due to discontinuities at the looping point may be prevented effectively from occurring.

As compared with the case of the ordinary compression encoding system, the sound source data in this case is increased only by the straight PCM data for the looping start point $LP_S$, and the compression rate as a whole remains unchanged, so that the memory capacity may be prevented from increasing.

With the above described technique of arranging the straight PCM data at the leading portion of the looping domain, a predetermined number of incipient words for a block or blocks following the first lock of the looping domain may be the words of the straight PCM data words, whereby it becomes possible to prevent errors from being produced when an arbitrary block or blocks are taken out and reproduced. The number of bits of the straight PCM data may also be equal to that of the compression data, for example, besides being equal to the number of bits of the original sampling wave height value data, and the straight PCM data compressed with the range data of the block at this time may be employed.

The present invention is not limited to the above described embodiment which are given for the sake of illustration and example only and not in the limiting sense. Thus the present invention may be applied to generation, recording or reproduction of various sound source data.

What is claimed is:

1. An apparatus for generating sound source data from waveform data having a repetitive waveform portion, including:

means for generating actual samples of the waveform data;

an interpolating means for interpolating a predetermined number of the actual samples to form interpolated samples; and selection means for selecting ones of the actual samples and the interpolated samples having closest value to each other for use as interconnecting samples of the repetitive waveform portion.

2. An interpolation filter for processing input data that have been sampled with a sampling frequency fs, wherein the sampling frequency fs has a sampling period corresponding thereto, said interpolation filter comprising a filter set formed by a set of m n'th order filters, where m is an integer not less than two, for finding digital data for each of m interpolating points present in the sampling period, from which digital data interpolation data is to be produced with resolution equal to m·fs, wherein the m n'th order filters are designed to have matched amplitude characteristics.

3. An apparatus for compression encoding of sound source data, including:

data generation means for generating compressed data words and parameters concerning compression from digital data corresponding to an analog waveform of a predetermined number of periods, wherein the data generation means includes means for generating one or more compression encoding blocks, each of said compression encoding blocks including a predetermined number of compressed data words and parameters concerning compression of the compressed data words, wherein straight pulse-code-modulated words are stored as a predetermined number of leading words of at least a first one of said compression encoding blocks, wherein said first one of said compression encoding blocks also includes non-pulse-code-modulated compressed data words.

4. A sound source device comprising:

a sound source data memory for storing sound source data including consecutive first plural samples and consecutive second plural samples, a starting address data memory for storing start address data associated with said first plural samples of the sound source data and looping start address data associated with said second plural samples of the sound source data, and an address generator for generating a read-out address of said sound source data memory on the basis of said start address data and said looping start address data, wherein the address generator includes:

means for reading out said first plural samples from a storage region of said sound source data memory beginning with a start address data determined by the start address data, after the start address data are loaded from the start address data memory into the address generator, and means for repeatedly reading out, after said looping start address data are loaded from said start address data memory into said address generator, said second plural samples from a storage region of said sound source data memory beginning with a looping start address determined by the looping start address data to reproduce analog or digital audio signals.

5. A sound source device comprising:

a sound source data memory for selectively storing sound source data, wherein the sound source data includes first samples representing a looping domain which is repetitively reproduced, and second samples which do not represent the looping domain, and an end sample, a flag check circuit for detecting discriminating flags indicating the presence or absence of the looping domain and the presence or absence of the end sample, means for repeatedly reading out said first samples from the sound source data memory and for reading out said second samples from said sound source data memory to reproduce analog or digital audio signals, and means for asserting a muting signal when the flag check circuit detects a discriminating flag which indicates the absence of the looping domain and the end of the sound source data.

6. An apparatus for reproducing continuous sound source data comprising:

a sound source memory having a first sound source memory area and a second sound source memory area, an address register designating a read-out address on the basis of a start address of said address register, control means for alternately reading sound source data from said first sound source memory area and said second source memory area on the basis of said read-out address, sound source data supply means for writing sound source data in a first one of said first sound source memory area and said second sound source memory area when sound source data are read out from a second one of said first sound source memory area and said second source memory area, start address supplying means for writing in said address register the start address of said first one of said first sound source memory area and said second sound source memory area in which said sound source data are written, and signal processing means for processing the sound source data read out from said first sound source memory area and said second source memory area.

* * * * *